US009235167B2

(12) United States Patent
Hasegawa

(10) Patent No.: US 9,235,167 B2
(45) Date of Patent: Jan. 12, 2016

(54) IMAGE HEATING APPARATUS

(71) Applicant: CANON KABUSHIKI KAISHA, Tokyo (JP)

(72) Inventor: Takuya Hasegawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/178,542

(22) Filed: Feb. 12, 2014

(65) Prior Publication Data

US 2014/0226998 A1 Aug. 14, 2014

(30) Foreign Application Priority Data

Feb. 13, 2013 (JP) ..... 2013-025457

(51) Int. Cl.
*G03G 15/20* (2006.01)

(52) U.S. Cl.
CPC .... *G03G 15/2017* (2013.01); *G03G 2215/2019* (2013.01)

(58) Field of Classification Search
USPC ..... 399/67
See application file for complete search history.

(56) References Cited

U.S. PATENT DOCUMENTS

| | | | | |
|---|---|---|---|---|
| 7,711,306 | B2 | 5/2010 | Kagawa | |
| 8,838,002 | B2 * | 9/2014 | Takahashi | 399/330 |
| 2007/0189817 | A1 | 8/2007 | Kagawa | |
| 2009/0092422 | A1 * | 4/2009 | Kagawa | 399/328 |
| 2009/0257767 | A1 * | 10/2009 | Funabiki | 399/68 |
| 2013/0209145 | A1 | 8/2013 | Hasegawa | |
| 2014/0086647 | A1 | 3/2014 | Hasegawa | |
| 2014/0093287 | A1 | 4/2014 | Hasegawa | |
| 2014/0153947 | A1 | 6/2014 | Hasegawa | |
| 2014/0153981 | A1 | 6/2014 | Hasegawa | |

FOREIGN PATENT DOCUMENTS

| | | | |
|---|---|---|---|
| JP | 2004-198658 | A | 7/2004 |
| JP | 2004-198659 | A | 7/2004 |
| JP | 2007-212896 | A | 8/2007 |

OTHER PUBLICATIONS

U.S. Appl. No. 14/178,557 to Takuya Hasegawa, filed Feb. 12, 2014, Status: Pending.

* cited by examiner

*Primary Examiner* — Christopher Mahoney
*Assistant Examiner* — Linda B Smith
(74) *Attorney, Agent, or Firm* — Fitzpatrick, Cella, Harper & Scinto

(57) ABSTRACT

An image heating apparatus includes: a rotating mechanism for rotating a belt unit in a direction for returning a belt into a predetermined zone; a displacing mechanism for permitting a first supporting member to be displaced in a direction for substantially equalizing forces, from the first supporting member, urging the belt toward a rotatable heating member at opposite end portions of the first supporting member with respect to a belt widthwise direction and to permit a second supporting member to be displaced in a direction for substantially equalizing forces, from the second supporting member, urging the belt toward the rotatable heating member at opposite end portions of the second supporting member; and a limiting mechanism for limiting the amount of the displacement permitted by the displacing mechanism within a predetermined amount.

22 Claims, 21 Drawing Sheets

(a)

(b)

(a)

(b)

(a)

(b)

(a)

(b)

(c)

IMAGE HEATING APPARATUS

FIELD OF THE INVENTION AND RELATED ART

The present invention relates to an image heating apparatus which heats a toner image on a sheet of recording medium.

In the field of an electrophotographic image forming apparatus, it has been a common practice to fix a toner image formed on a sheet of recording medium with the use of an electrophotographic process, to the sheet of recording medium, by applying heat and pressure to the sheet and the toner image thereon, with the use of a fixing apparatus (device) which is an example of an image heating apparatus (device).

In the recent years, an electrophotographic image forming apparatus has been increased in speed. Thus, it has become a common practice to equip a fixing apparatus (device) with an external means for externally heating the fixation roller (rotational heating member) of the fixing device. One of such external heating means which employ a heat belt has been proposed in Japanese Laid-open Patent Applications 2004-198658, and 2007-212896.

More concretely, in the case of the apparatus disclosed in Japanese Laid-open Patent Application 2004-198659, an external heat belt is supported and kept stretched by three belt supporting rollers, and is placed in contact with the peripheral surface of the fixation roller. In the case of Japanese Laid-open Patent Application 2007-212896, an external heat belt is suspended and kept stretched by two belt supporting rollers, and is placed in contact with the peripheral surface of the fixation roller.

Realistically speaking, it is rather difficult to assembly a fixing device so that its rollers for supporting, and keeping stretched, its external heat belt, become, and remain, virtually perfectly parallel to each other. However, unless the two rollers remain perfectly parallel to each other, the external heat belt deviates in its widthwise direction, and therefore, it is likely for the external heat belt to become unstable in its rotational movement. Thus, there have been devised various methods for controlling the external heat belt in its deviation in its widthwise deviation. One of such methods is to slant one of the two belt supporting rollers relative to the other. However, in a case where the external heat belt is employed to heat a fixation roller, it is difficult to satisfactorily employ this method, for the following reason.

That is, in the case of this method, the external heating unit is structured so that one of the lengthwise ends of one of the belt supporting rollers is displaced relative to the other lengthwise end. Thus, it is possible that a part of the external heat belt, which is to remain in contact with the fixation roller, is separated from the fixation roller by the displacement of the belt supporting roller. Therefore, it is possible that the external heat belt will fail to satisfactorily heat the fixation roller. Therefore, it is possible that unsatisfactory fixation will occur.

SUMMARY OF THE INVENTION

According to an aspect of the present invention, there is provided an image heating apparatus includes a rotatable heating member configured to heat a toner image on a recording material; a belt unit including an endless belt configured and positioned to contact with said rotatable heating member to heat it, and first and second supporting members rotatably supporting an inner surface of said belt and configured to urge said belt to said rotatable heating member; a detector configured and positioned to detect that said belt is deviated from a predetermined zone with respect to a widthwise direction said belt; a rotating mechanism configured to rotate said belt unit in a direction for returning said belt into the predetermined zone; a displacing mechanism configured to permit said first supporting member to displace, with rotation of said belt unit by said rotating mechanism, in a direction for substantially equalizing forces, from said first supporting member, urging said belt toward said rotatable heating member at opposite end portions of said first supporting member with respect to the widthwise direction and to permit said second supporting member to displace, with the rotation of said belt unit by said rotating mechanism, in a direction for substantially equalizing forces, from said second supporting member, urging said belt toward said rotatable heating member at opposite end portions of said second supporting member with respect to the widthwise direction; and a limiting mechanism configured and positioned to limit an amount of the displacement permitted by said displacing mechanism within a predetermined amount.

According to another aspect of the present invention, there is provided an image heating apparatus comprising a rotatable heating member configured to heat a toner image on a recording material; a belt unit including an endless belt configured and positioned to contact with said rotatable heating member to heat it, and first and second supporting rollers rotatably supporting an inner surface of said belt and configured to urge said belt to said rotatable heating member; a detector configured and positioned to detect that said belt is deviated from a predetermined zone with respect to a widthwise direction said belt; a rotating mechanism configured to rotate said belt unit in a direction for returning said belt into the predetermined zone; a displacing mechanism configured to permit said first and second rollers to displace, with rotation of said belt unit by said rotating mechanism, into a positional relation in which axes of said first and second supporting rollers are skewed relative to each other; and a limiting mechanism configured and positioned to limit an amount of the displacement permitted by said displacing mechanism within a predetermined amount.

Further features of the present invention will become apparent from the following description of exemplary embodiments (with reference to the attached drawings).

DESCRIPTION OF THE PREFERRED EMBODIMENTS

Hereinafter, the embodiments of the present invention are described in detail with reference to appended drawings.

<Image Forming Apparatus>

Figure 1:
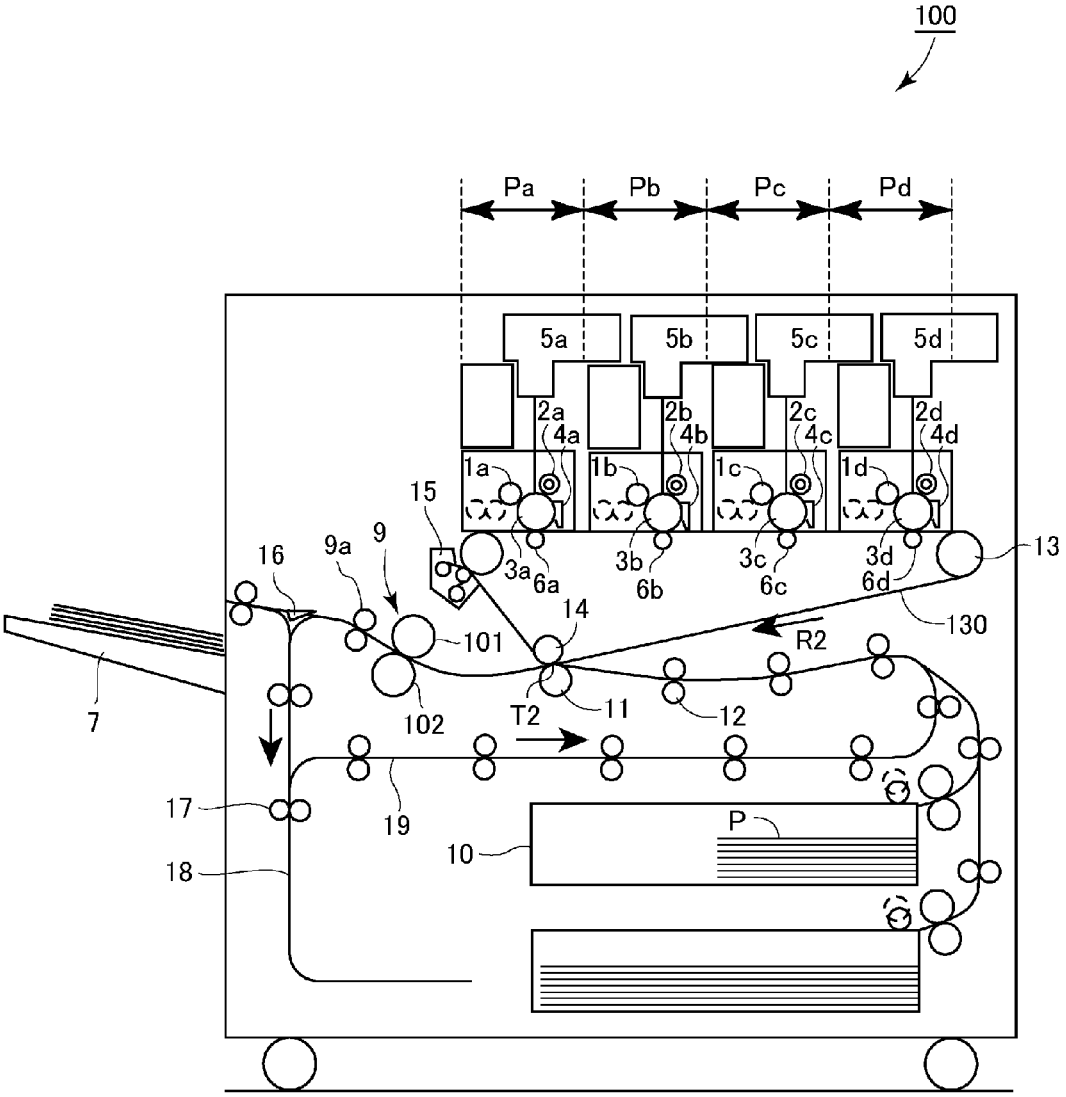
FIG. 1 is a schematic drawing for describing the structure of a typical image forming apparatus to which the present invention is applicable.

FIG. 1 is a schematic drawing for describing the structure of a typical image forming apparatus to which the present invention is applicable. Referring to FIG. 1, an image forming apparatus 100 is a full-color printer of the tandem-type, and also, of the intermediary transfer type. It has image formation stations Pa, Pb, Pc and Pd for forming yellow, magenta, cyan and black toner images, respectively, and an intermediary transfer belt 130. The four image formation stations are aligned in parallel (tandem) along the intermediary transfer belt 130.

In the image formation station Pa, a yellow toner image is formed on a photosensitive drum 3*a*, and is transferred (primary transfer) onto the intermediary transfer belt 130. In the image formation station Pb, a magenta toner image is formed, and is transferred (primary transfer) onto the intermediary transfer belt 130. In the image formation stations Pc and Pd, cyan and black toner images, respectively, are formed, and are transferred (primary transfer) onto the intermediary transfer belt 130. That is, the yellow, magenta, cyan, and black toner images are sequentially transferred (primary transfer) onto the intermediary transfer belt 130.

Sheets P of recording medium in a recording medium cassette 10 are moved out of the cassette 10 one by one, and each sheet P is conveyed to a pair of registration rollers 12, at which the sheet P is kept on standby. Then, the registration rollers 12 convey the sheet P to the secondary transfer station T2, with such a timing that the sheet P reaches the secondary transfer station T2 at the same time as the four toner images, different in color, on the intermediary transfer belt 130. Then, while the sheet P is conveyed through the secondary transfer station T2, the toner images are transferred (secondary transfer) from the intermediary transfer belt 130 onto the sheet P. Then, the sheet P is conveyed to the fixing device 9, in which the sheet P and the toner images thereon are subjected to heat and pressure, whereby the toner images are fixed to the sheet P. Then, the sheet P is discharged into the external delivery tray 7 of the image forming apparatus 100.

The image formation stations Pa, Pb, Pc and Pd are practically the same in structure, although they are different in the color of the toner used by their developing devices 1*a*, 1*b*, 1*c* and 1*d*, respectively. Thus, only the image formation Pa is described, in order not to repeat the same descriptions.

The image formation station Pa has the photosensitive drum 3*a*, a charge roller 2*a*, an exposing device 5*a*, a developing device 1*a*, a primary transfer roller 6*a*, and a drum cleaning device 4*a*. The charge roller 2*a*, exposing device 5*a*, developing device 1*a*, primary transfer roller 6*a*, and drum cleaning device 4*a* are disposed in the adjacencies of the peripheral surface of the photosensitive drum 3*a*, in the listed order. The photosensitive drum 3*a* is made up of an aluminum cylinder, and a photosensitive layer formed on the peripheral surface of the aluminum cylinder.

The charge roller 2*a* uniformly charges the peripheral surface of the photosensitive drum 3*a* to a preset potential level. The exposing device 5*a* writes an electrostatic image on the peripheral surface of the photosensitive drum 3*a*, by scanning the uniformly charge portion of the peripheral surface of the photosensitive drum 3*a*, with a beam of laser light which it emits. The primary transfer roller 6*a* transfers (primary transfer) the toner images on the peripheral surface of the photosensitive drum 3*a* onto the intermediary transfer belt 130, by being given voltage.

The drum cleaning device 4*a* is provided with a cleaning blade. It recovers the transfer residual toner, which is the toner having escaped from the primary transfer process, and therefore, remaining adhered to the peripheral surface of the photosensitive drum 3*a* after the primary transfer, by causing the cleaning blade to scrape the peripheral surface of the photosensitive drum 3*a*. The belt cleaning device 15 recovers the transfer residual toner, which is the toner having escaped from the process carried out in the secondary transfer station T2 to transfer the toner on the intermediary transfer belt 130 onto the sheet P of recording medium, and therefore, remaining on the intermediary transfer belt 130 after the secondary transfer.

Embodiment 1

Figure 2:
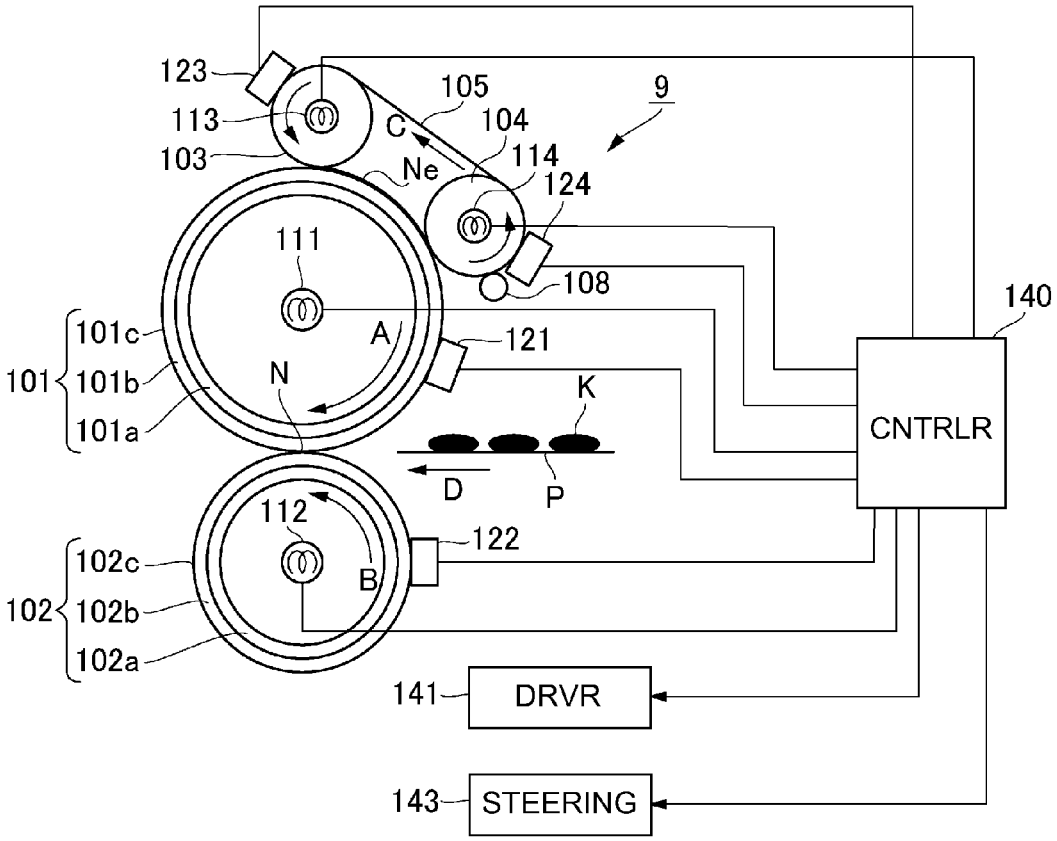
FIG. 2 is a schematic drawing for describing the structure of the fixing device in the first embodiment of the present invention.

Referring to FIG. 2, a fixation roller 101, which is an example of a rotational member, rotates in contact with a sheet P of recording medium. An external heat belt 105, which is an example of member in the form of a belt is for adjusting the fixation roller 101 in thermal characteristic. It rotates in contact with the fixation roller 101.

The first and second support rollers 103 and 104, which are examples of multiple belt supporting members (rotational belt supporting members), support, and keep stretched, the external heat belt 105. A thermistor 123 which is an example of a temperature detecting member (temperature detection element) is placed in contact with the outward surface of the external heat belt 105 to detect the temperature of the belt 105.

Figure 3:
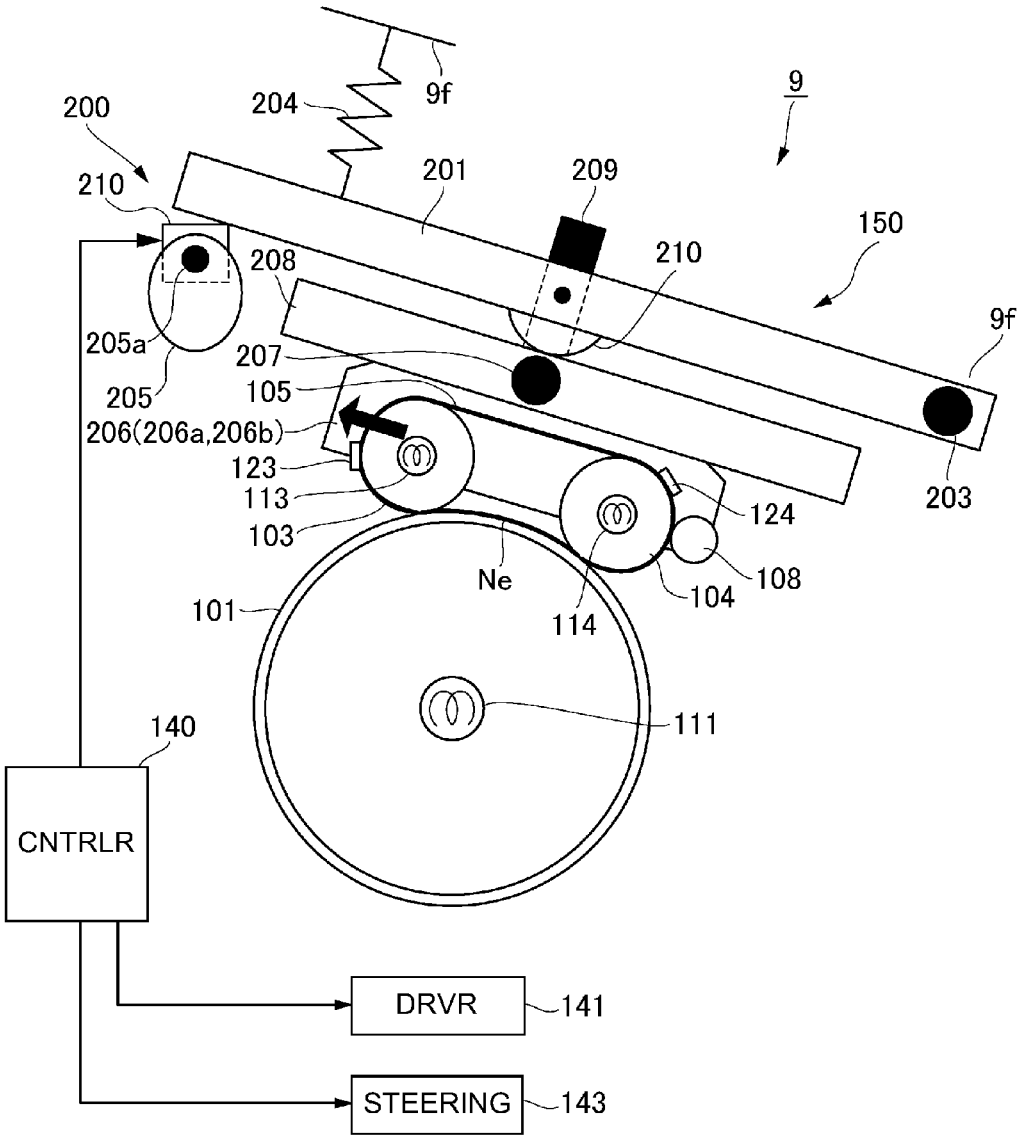
FIG. 3 is a schematic drawing for describing the engaging-disengaging mechanism, in the first embodiment, for placing the external heating belt in contact with, or separating the external heating belt from, the fixing roller.

Referring to FIG. 3, a holding frame 206*a* which is an example of the first holding member (which is part of displacing mechanism or skewing mechanism, as well, which is described later) rotatably holds one of the lengthwise ends of the first support roller 103, and the corresponding lengthwise end of the second support roller 104. A holding frame 206*b* which is an example of the second holding member (which is part of displacing mechanism, which will be described later) rotatably holds the other lengthwise end of the first support roller 103, and the corresponding lengthwise end of the second holding roller 104. A middle frame 208 which is an example of a displacing mechanism (rotational mechanism) rotatably supports the support frames 206*a* and 206*b* in such a manner that the first and second support rollers 103 and 104 can be slanted (angled) relative to each other.

Figure 7:
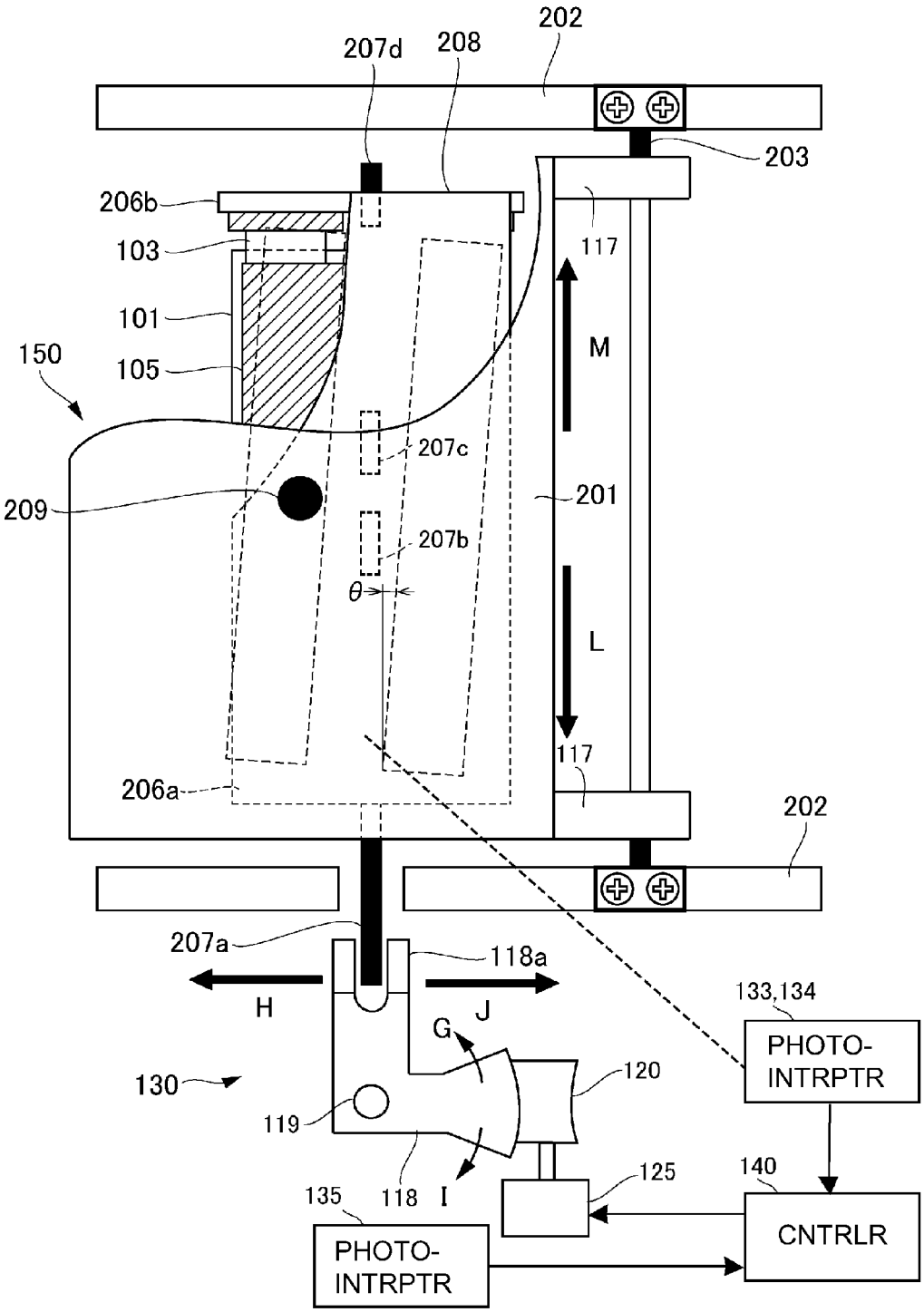
FIG. 7 is a schematic drawing for describing the steering mechanism for steering the external heat belt.

Referring to FIG. 7, a worm wheel 118 which is an example of a rotational mechanism controls the external heat belt 105 in position in terms of the widthwise direction of the external heat belt 105, that is, the direction parallel to the lengthwise direction of the first and second rollers 103 and 104. The worm wheel 118 rotationally moves the middle frame 208 in such a manner that the generatrix of the external heat belt 105 and the generatrix of the fixation roller 101 are angled relative to each other. A photo-interrupters 133 and 134 detect the position of the external heat belt 105 in terms of the widthwise direction of the external heat belt 105, that is, the direction parallel to the lengthwise direction of the first and second support rollers 103 and 104. A control section 140 is a part of the abovementioned rotational mechanism. It controls the external heat belt 105 in position, by moving the worm wheel 118 in response to the outputs of the photo-interrupters 133 and 134.

Figure 15:
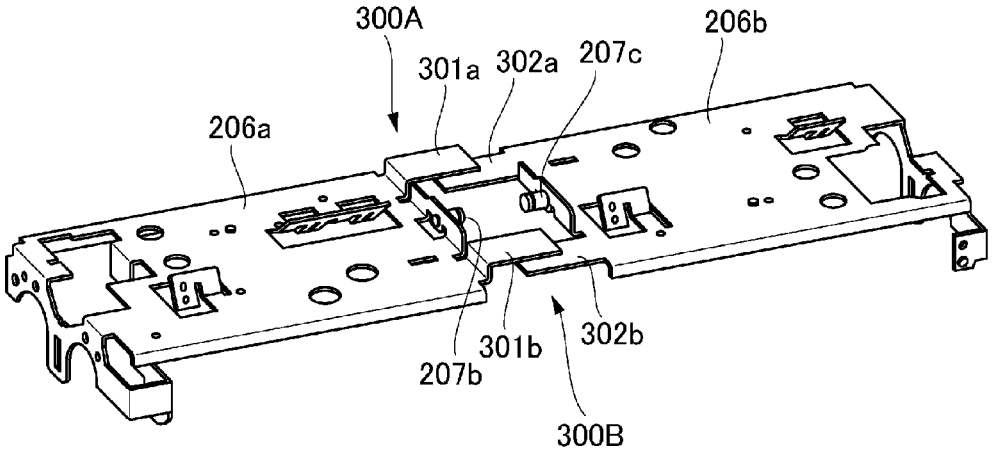
FIG. 15 is a perspective view of the regulating portion.

Referring to FIG. 15, regulating portions 300A and 300B, which are examples of a regulating mechanism, function as a stopper for limiting to a preset value, the maximum angle by which the holding frames 206*a* and 206*b* are rotationally movable relative to each other. Next, referring to FIG. 18, a preset angle (γ) is greater than the maximum angle ($\beta_{max}$) by which the holding frames 206*a* and 206*b* are allowed to be rotationally move relative to each other, in order to control the lateral deviation of the external heat belt 105.

Referring to FIG. 15, bent portions 301*a* and 301*b*), which are examples of the first portion of contact, extend from the inward edge of the holding frame 206*a* toward the holding frame 20*b*, along the first and second support rollers 103 and 104. Flat portions 302*a* 302*b*, which are examples of the second portion of contact, extend from the inward edge of the holding frame 206*b* toward the holding frame 206*a*, along the first and second support rollers 103 and 104. In terms of the direction in which the external heat belt 105 is suspended and stretched, the bent portion 301*a* and 301*b* are positioned, on one side of the combination of the first and second holding frames 206*a* and 206*b*, in such a manner that as the holding frames 206*a* and 206*b* are rotationally moved relative to each other, they overlap with each other. Further, the bent portion 302*a* and 202*b* are positioned, on the other side of the combination of the first and second holding frames 206*a* and 206*b*, in such a manner that as the holding frames 206*a* and 206*b* are rotationally moved relative to each other, they overlap with each other.

Figure 14:
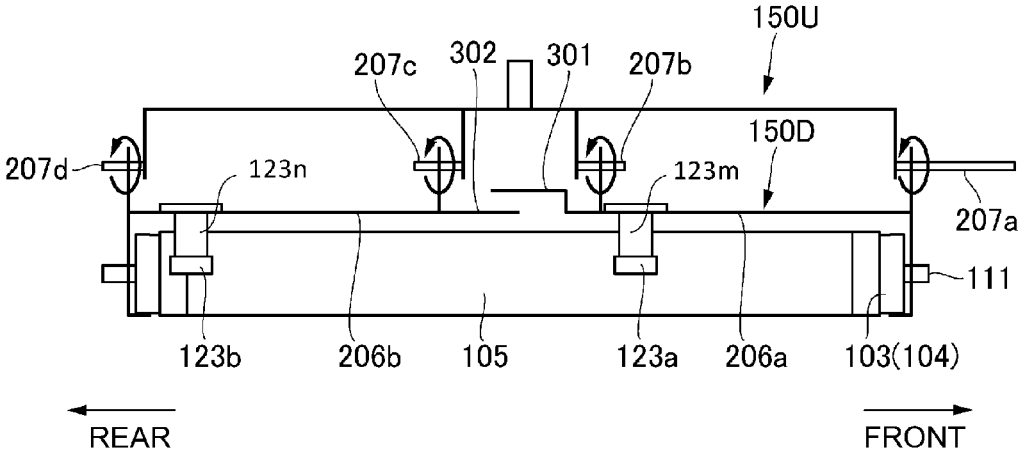
FIG. 14 is a schematic drawing for describing the movement of the holding frames.

Referring to FIG. 14, a thermistor 123*a* is attached to one of the lengthwise ends of a leaf spring 123*m*, which is an example of a beam-like member (pressing member). The other lengthwise end of the leaf spring 123*m* is fixed to the holding frame 206*a*. That is, the leaf spring 123*m* is attached to the holding frame 206*a*, acting thereby like a cantilever. It keeps the thermistor 123*a* in contact with the external heat belt 105 by being elastically bent. The aforementioned preset angle (γ) is set to be smaller than the maximum angle by which the holding frames 206*a* and 206*b* are allowed to rotationally move relative to each other while ensuring that the elastic deformation of the leaf spring 123*m* can keep thermistor 123*a* in contact with the external heat belt 105.

(Fixing Device)

FIG. 2 is a schematic drawing for describing the structure of the fixing device in the first embodiment of the present invention. Referring to FIG. 2, the fixing device 9 has the fixation roller 101 and pressure roller 102. It is structured so that the pressure roller 102 is pressed upon the fixation roller 101 to form a nip N, through which a sheet P of recording medium, across which an unfixed toner image K is borne, is conveyed, remaining pinched by the fixation roller 101 and pressure roller 102, so that the toner, of which the unfixed toner image K is formed, is melted and becomes fixed to the surface of the sheet P.

The fixation roller 101 has: a metallic core 101*a*; an elastic layer 101*b* formed across the entirety of the peripheral surface of the metallic core 101*a*; and a parting layer 101*c* formed across the entirety of the outward surface of the elastic layer 101*b*. The fixation roller 101 is driven by a driving mechanism 141 which includes an unshown gear train. It is rotated in the direction indicated by an arrow mark A in FIG. 2, at a process speed of 300 mm/sec.

The pressure roller 102 has: a metallic core 102*a*; an elastic layer 102*b* formed across the entirety of the peripheral surface of the metallic core 102*a*; and a parting layer 102*c* formed across the entirety of the outward surface of the elastic layer 102*b*. It is driven by the driving system 141, and rotates in the direction indicated by an arrow mark B in FIG. 2. The pressure roller 102 is placed in contact with, or separated from, the fixation roller 101, by being driven by an unshown pressure applying mechanism which employs an eccentric cam. The unshown pressure applying mechanism applies a preset amount of pressure to the pressure roller 102 to press the pressure roller 102 upon the fixation roller 101, forming the nip N between the fixation roller 101 and pressure roller 102.

The halogen heater 111 is non-rotationally disposed in the hollow of the metallic core 101*a* of the fixation roller 101. A thermistor 121 is disposed in contact with the fixation roller 101 to detect the surface temperature of the fixation roller 101. The control section 140 turns on or off the halogen heater 111 in response to the surface temperature of the fixation roller 101 detected by the thermistor 121, in order to keep the surface temperature of the fixation roller 101 at a preset target level, which is set according to recoding medium type.

The halogen heater 112 is non-rotationally disposed in the hollow of the metallic core 102*a* of the pressure roller 102. A thermistor 122 is placed in contact with the pressure roller 102 to detect the surface temperature of the pressure roller 102. The control section 140 turns on or off the halogen heater 112 in response to the surface temperature of the pressure roller 102 detected by the thermistor 122, in order to keep the surface temperature of the pressure roller 102 at a preset target level.

(External Heat Belt)

Referring to FIG. 2, the image forming apparatus is required to be high in productivity (print output count per unit length of time) even when such recording medium as a sheet of cardstock or the like which is large in basis weight (weight per unit area), is used for image formation. In order to keep the image forming apparatus 100 high in productivity even when the recording medium used for an image forming operation is large in basis weight, the fixing device 9 of the image forming apparatus has to be enabled to remain high in heating performance even when the recording medium used for the image forming operation is large in basis weight. The amount by which recording medium which is large in basis weight robs heat from the fixation roller 101 is larger than the amount by which ordinary paper robs heat from the fixation roller 101. Therefore, the amount of heat which the former require for fixation is greater than that for the latter. Thus, the fixing device 9 is structured so that the external heat belt 105 can be placed in contact with, or separated from, the fixation roller 101. The external heat belt 105 increases the first and second support rollers 103 and 104 in the efficiency with which the rollers 103 and 104 can heat the fixation roller 101, by increasing in size the area of indirect contact between the first and second rollers 103 and 104 and the fixation roller 101, through which heat is conducted from the two rollers 103 and 104 to the fixation roller 101.

The external heat belt 105 is placed in contact with the peripheral surface of the fixation roller 101, forming thereby a nip Ne, in which it externally heats the fixation roller 101. The external heat belt 105 has a substrative layer formed of a metallic substance such as stainless steel and nickel, or resinous substance such as polyimide. In order to prevent toner from adhering to the substrative layer of the external heat belt 105, the surface of the substrative layer is provided with a heat resistant slippery layer formed of fluorinated resin. The external heat belt 105 is driven by the friction which occurs between the peripheral surface of the fixation roller 101 and external heat belt 105 as the fixation roller 101 is rotated; it is rotated by the rotation of the fixation roller 101 in the direction indicated by an arrow mark C in FIG. 2.

The first support roller 103 is formed of a metallic substance, such as aluminum, iron, stainless steel, etc., which is high in thermal conductivity. There is stationarily disposed a halogen heater 113, in the hollow of the first support roller 103, in such a manner that the axial line of the halogen heater 113 coincides with the rotational axis of the first support roller 103. A thermistor 123 is placed in contact with the portion of the external heat belt 105, which is supported by the first support roller 103, and detects the temperature of the external heat belt 105. The control section 140 turns on or off the halogen heater 113 in response to the temperature of the external heat belt 105 detected by the thermistor 123, in order to keep the temperature of the first support roller 103 at a preset target level.

The second support roller 104 is formed of a metallic substance, such as aluminum, iron, stainless steel, etc., which is high in thermal conductivity. There is stationarily disposed a halogen heater 114, in the hollow of the second support roller 104, in such a manner that the axial line of the halogen heater 114 coincides with the rotational axis of the second support roller 104. A thermistor 124 is placed in contact with the portion of the external heat belt 105, which is supported by the first support roller 104, and detects the temperature of the external heat belt 105. The control section 140 turns on or off the halogen heater 114 in response to the temperature of the external heat belt 105 detected by the thermistor 124, in order to keep the temperature of the second support roller 104 at a preset target level.

The target levels for the temperature control of the first and second support rollers 103 and 104 are set higher than the target level for the temperature control of the fixation roller 101. Because the surface temperature of the first support roller 103 and the surface temperature of the second support roller 104 are kept higher than the surface temperature of the fixation roller 101, heat is efficiently supplied to the fixation roller 101, as the fixation roller 101 reduces in surface temperature. More concretely, in an image forming operation in which sheets of cardstock or the like are continuously conveyed, the target temperature level for the fixation roller 101 is set to 165° C., whereas the target temperature level for the first support roller 103, and that for the second support roller 104, are set higher by 75° C. than that for the fixation roller 101.

The surface layer of the external heat belt 105 is soiled by adhesive contaminants such as toner particles, paper dust, and the like which offset to the external heat belt 105 from a sheet P of recording medium. The cleaning roller 108 has a surface layer formed of silicon rubber, and adheres the toner particles, paper dust, and the like on the surface layer of the external heat belt 105, to its surface layer. The cleaning roller 108 is kept pressed upon the external heat belt 105 by a preset amount of pressure. It cleans the surface of the external heat belt 105 by being rotated by the rotation of the external heat belt 105.

When the fixing device 9 is kept on standby for the next job, its external heat belt 105 is kept separated from its fixation roller 101. As an image formation job is sent to the image forming apparatus 100, various preparatory operations are started by various devices in the image forming apparatus 100. One of the preparatory operation is the warmup operation started by the fixing device 9. As the fixation roller 101, and pressure roller 102 reach their target temperature level in the warmup operation, the external heat belt 105 is pressed upon the fixation roller 101. Then, the image formation job is started. As the image formation job is completed, the external heat belt 105 is separated from the fixation roller 101, and then, it is kept separated from the fixation roller 101 until the next image formation job is started.

(Angle Between Two Support Rollers)

Figure 4:
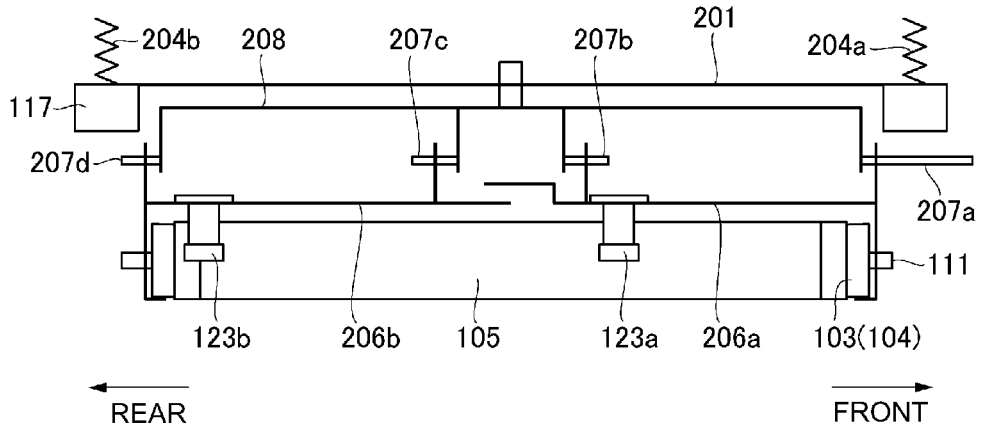
FIG. 4 is a schematic drawing for describing the mechanism for rotationally moving the holding frames.
Figure 5:
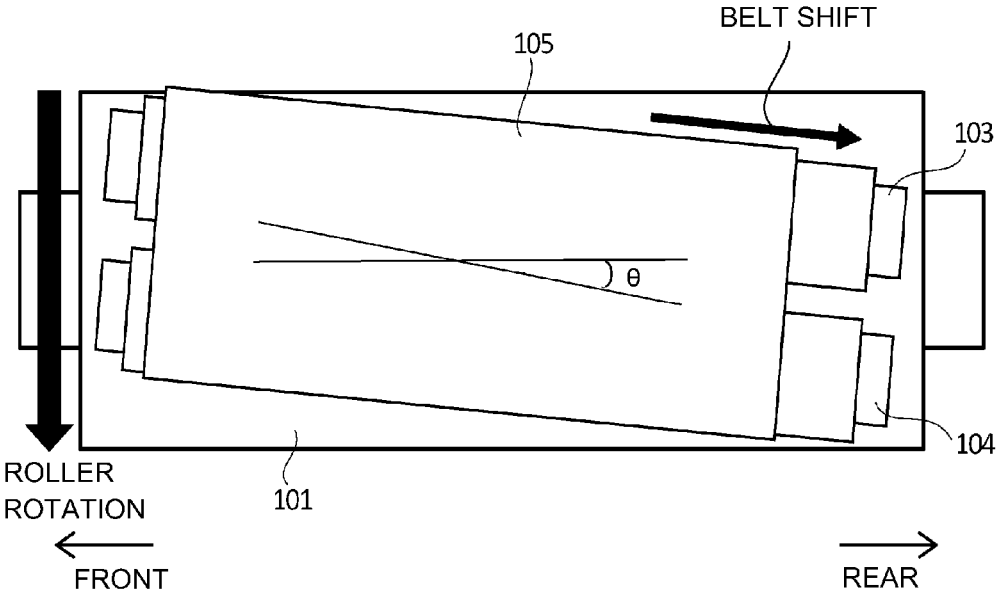
FIG. 5 is a schematic drawing for describing the angle between the generatrix of the fixation roller and that of the external heat belt.
Figure 6:
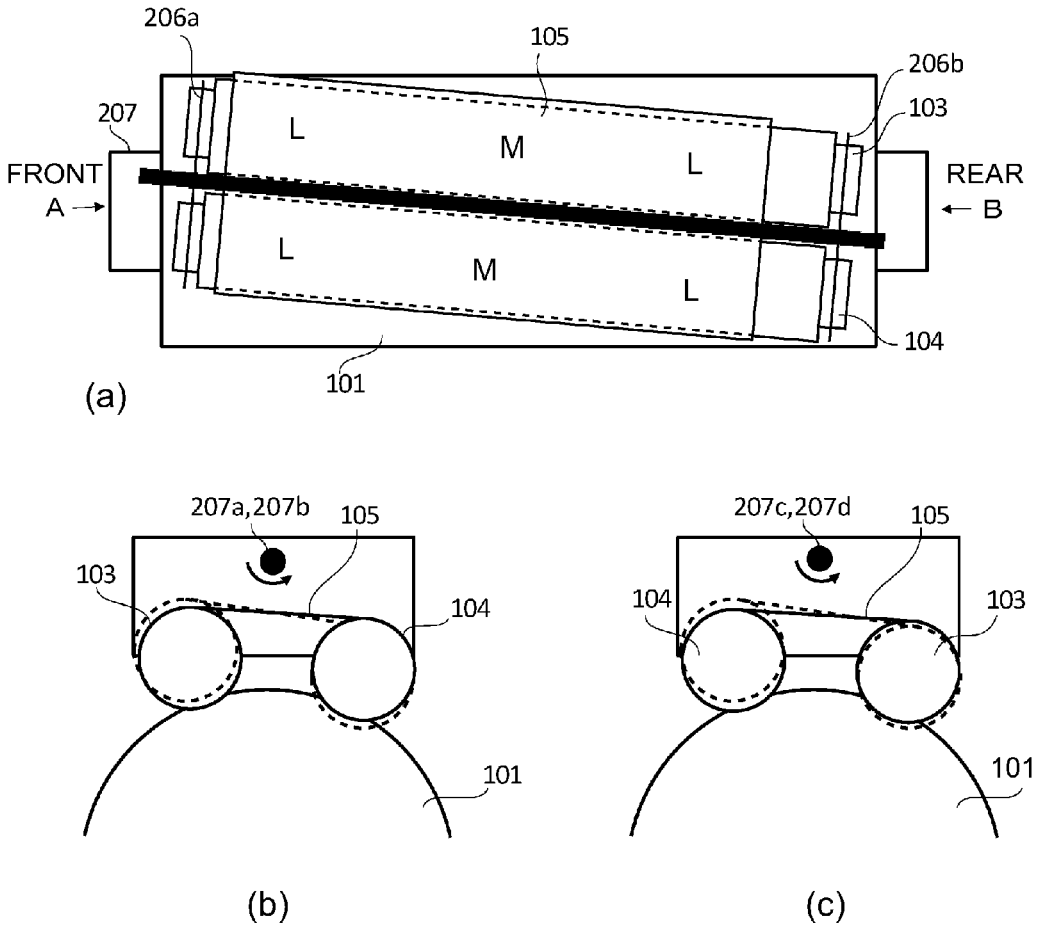
FIG. 6 is a schematic drawing for describing how the rotational movement of the external heating unit can cancel the effect of the controlling of the lateral deviation of the external heat belt (how rotational movement of the external heating unit can prevent nip between external heat belt and fixation roller from becoming nonuniform in internal pressure).

FIG. 3 is a schematic sectional drawing for an engaging-disengaging mechanism for placing the external heat belt 105 in contact with the fixation roller 101, or separating the external heat belt 105 from the fixation roller 101. FIG. 4 is a schematic drawing for describing the mechanism for rotationally moving the holding frames. FIG. 5 is a schematic drawing for describing the skew angle between the generatrix of the fixation roller and that of the external heat belt 105. FIG. 6 is a schematic drawing for describing the effects of the angle of rotational movement of the external heating unit 150 of the fixing device 9, upon the prevention of the problem that controlling the external heat belt 150 in lateral deviation makes the nip between the external heat belt 105 and fixation roller 101, nonuniform in internal pressure.

Referring to FIG. 3, the external heating unit 150 is structured so that the external heat belt 105 is suspended and kept stretched by the first and second support rollers 103 and 104, in such a manner that the external heat belt 105 is rotated by the rotation of the fixation roller 101.

The external heat belt 105 can be placed in contact with, or separated from, the fixation roller 101 by the engaging-disengaging mechanism 200. The mechanism 200 doubles as the mechanism for pressing the first and second support rollers 103 and 104 against the fixation roller 101 with the placement of the external heat belt 105 between the two support rollers 103 and 104 and the fixation roller 101. A pressure application frame 201 is pivotally movable relative to the frame 9*f* of the fixing device 9, about a pivot 203, by which the pressure application frame 201 is supported.

There is disposed a compression spring 204 between the lengthwise opposite end portion of the pressure application frame 201 from the pivot 203, and the frame 9*f* of the fixing device 9. Thus, the compression spring 204 presses downward the opposite end of the pressure application frame 201 from the pivot 203, pressing thereby the pressure application frame 201 toward the fixation roller 101. The middle frame 208 is supported by a pair of middle rollers 210, disposed on the front and rear sides of the middle frame 208, in such a manner that they can be rotationally moved relative to the pressure application frame 201. While the first and second support rollers 103 and 104 are remaining pressed against the fixation roller 101, with the presence of the external heat belt 105 between the two rollers 103 and 104 and the fixation roller 101, the overall amount of pressure generated by the compression spring 204 is 392 N (roughly 40 kgf).

A pressure removal cam 205 is placed in contact with, or separated from, the bottom surface of the tip portion of the pressure application frame 201. The control section 140 controls a motor 210 to rotate the pressure removal cam 205 to pivotally move the pressure application frame 201 about the axle 205*a* so that the tip portion of the pressure application frame 201 moves upward or downward. As the pressure removal cam 205 is separated from the pressure application frame 201, the compression spring 204 is allowed to extend to move downward the tip portion of the pressure application frame 201, and therefore, the external heat belt 105 is pressed upon the fixation roller 101. As the pressure removal cam 205 moves the pressure application frame 201 upward while compressing the compression spring 204, the external heat belt 105 is separated from the fixation roller 101.

Referring to FIG. 4, the front end of the first support roller 103, and the front end of the second support roller 104, are supported by the front holding frame 206*a*, which is supported by the axles 207*a* and 207*b* so that it is allowed to rotationally move relative to the middle frame 208. The holding frame 206*a* rotatably holds the front end of the first support roller 103, and the front end of the second support roller 104, with the placement of unshown thermally insulating bushing, and bearing, between the holding frame 206*a* and first and second support rollers 103 and 104. That is, one of the lengthwise ends of the first support roller 103, and the corresponding end of the second support roller 104, are rotationally supported by the unshown bearings fixed to the holding frames 206*a*, which is rotatably supported by the axles 207*a* and 207*b*, respectively, with which the middle frame 208 is provided.

The rear end of the first support roller 104, and the rear end of the second support roller 104, are supported by the rear holding frame 206*b*, which is supported by the axles 207*c* and 207*d* so that it is allowed to rotationally move relative to the middle frame 208. The holding frame 206*b* supports the rear end of the first support roller 103, and the rear end of the second support roller 104, with the placement of unshown thermally insulating bushing, and bearing, between the holding frame 206*b* and first and second support rollers 103 and 104. That is, one of the lengthwise ends of the second support roller 103, and the corresponding end of the second support roller 104, are rotationally supported by unshown bearings fixed to the holding frame 206*b*, which is rotatably supported by the axles 207*c* and 207*d*, respectively, with which the middle frame 208 is provided. The shafts 207*a*-207*d* are coaxial.

Referring to FIG. 4, there are disposed compression springs 204*a* and 204*b* at the lengthwise ends of the pressure application frame 201, one for one. The compression springs 204 apply a preset amount of pressure to the first and second support rollers 103 and 104 to press the external heat belt 105 upon the peripheral surface of the fixation roller 101. The line which is perpendicular to the axle 207 (207*a*, 207*b*, 207*c* and 207*d*) and coincident to the center of the axle 207 and the axial line of the fixation roller 101 is perpendicular to, and bisects, the line which is coincident to the center of the first support roller 103 and the center of the second support roller 104.

Referring to FIG. 5, in a case where the angle between the generatrix of the external heat belt 105 and that of the fixation roller 101 is θ, the rear end of the first support roller 103 or the rear end of the second support roller 104 begins to press the fixation roller 101 before the other, and at the same time, the corresponding front end of the first support roller 103 or the second support roller 104 begins to press the fixation roller 101 before the other. That is, the first support roller 103 (or second support roller 104) is slanted (angled) in such a manner that one of the lengthwise end of the first support roller 103 (or second support roller 104) digs into the fixation roller 101, and the other lengthwise end separates from the fixation roller 101. Therefore, unless the external heating unit 150 is not provided with a displacing mechanism (rotational mechanism), the nip between the fixation roller 101 and external heat belt 105 becomes nonuniform in internal pressure in terms of the lengthwise direction of the fixation roller 101.

On the other hand, in the case of a fixing device provided with a displacing mechanism (rotational mechanism) as shown in FIG. 6(*a*), the difference between the first and second support rollers 103 and 104 in the amount of pressure they apply to the fixation roller 101 causes the front and rear holding frames 206*a* and 206*b*, respectively, to rotationally move. Thus, the first and second support rollers 103 and 104 are autonomously equalized in the amount of pressure they apply to the fixation roller 101. More concretely, the front and rear holding frames 206*a* and 206*b* are rotationally moved relative to each other in the direction perpendicular to their lengthwise direction, being thereby positioned to accommodate the curvature of the fixation roller 101. There is no limit to the angle by which the first and second support rollers 103 and 104 are rotationally moved relative to each other. Therefore, the first and second support rollers 103 and 104 autonomously adjust themselves in attitude, positioning themselves to accommodate the curvature of the fixation roller. Therefore, the external heat belt 105 is kept perfectly in contact with the fixation roller 101.

Next, referring to FIG. 6(*b*), on the front side of the fixing device 9, the holding frame (206*a*) rotates about the axles 207*a* and 207*b* in such a manner that the difference between the amount of pressure between the first support roller 103 and fixation roller 101, and that between the second support roller 104 and fixation roller 101 is eliminated. Next, referring to FIG. 6(*c*), on the rear side of the fixing device 9, holding frame (206*b*) rotates about the axles 207*c* and 207*d* in such a manner that the difference between the amount of pressure between the first support roller 103 and fixation roller 101, and that between the second support roller 104 and fixation roller 101 is eliminated. Therefore, even though the angle θ between the external heat belt 105 and fixation roller 101 is changed by the controlling of the lateral deviation of the external heat belt 105, the nip between the external heat belt 105 and fixation roller 101 remains uniform in the internal pressure.

That is, the first and second support rollers 103 and 104 become the same in the amount of pressure by which they are pressed against the fixation roller 101. Therefore, the fixation roller 101 is satisfactorily heated by the first and second support rollers 103 and 104 through the external heat belt 105, across its front side as well as the rear side.

(Steering Mechanism)

Figure 8:
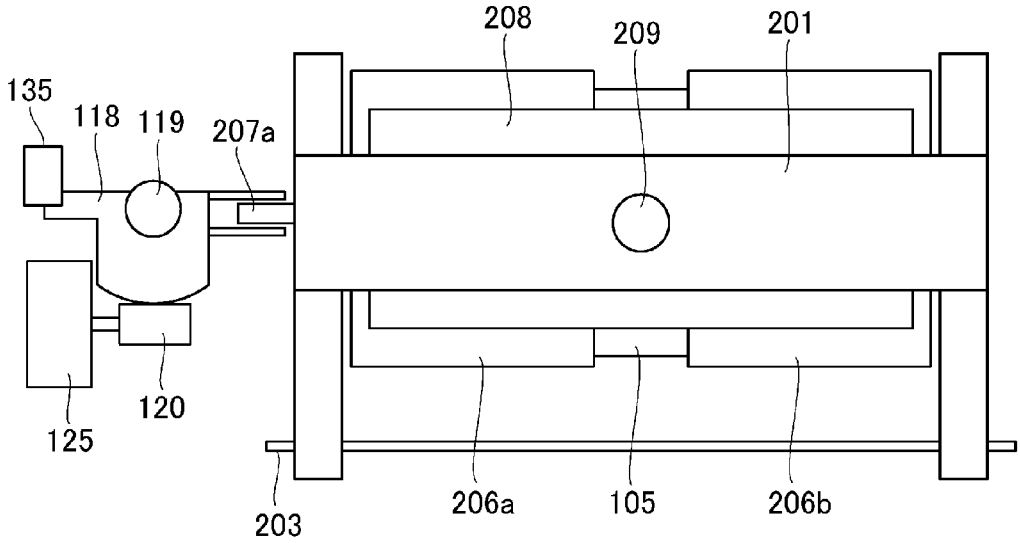
FIG. 8 is a schematic drawing for describing the driving portion section for driving the steering mechanism.
Figure 9:
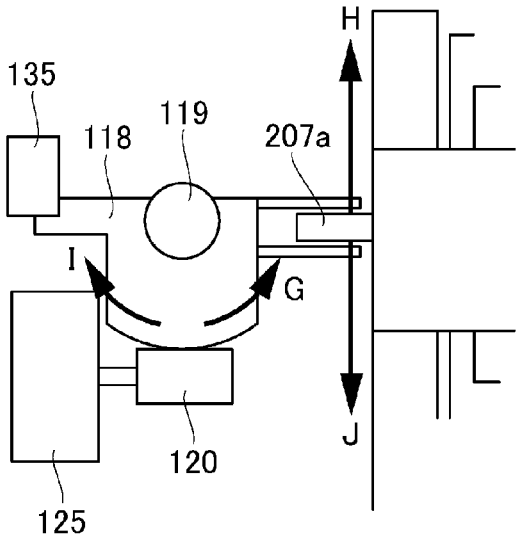
FIG. 9 is an enlarged schematic view of the driving portion of the steering mechanism.

FIG. 7 is a schematic drawing for describing the mechanism (rotational mechanism) for steering the external heat belt 105. FIG. 8 is a schematic drawing for describing the driving portion of the steering mechanism. FIG. 9 is an enlarged view of the driving portion of the steering mechanism.

Referring to FIG. 2, the fixing device 9 is structured so that the adverse effect of the controlling of the lateral deviation of the external heat belt 105 is cancelled by rotationally moving the external heating unit 150 while keeping the first and second support rollers 103 and 104 unchanged in positional relationship.

Referring to FIG. 5, in a case where the angle between the external heat belt 105 and fixation roller 101 is θ when the external heat belt 105 came into contact with the fixation roller 101, the rotation of the fixation roller 101 generates a force that presses the external heat belt 105 in the direction which is parallel to the lengthwise direction of the first and second support rollers 103 and 104. This principle (phenomenon) is used by the fixing device 9 to set the direction in which the external heat belt 105 is made to laterally shift. That is, the angle θ is intentionally changed to set the direction in which the external heat belt 105 is made to laterally shift.

As the external heat belt 105 is rotated, it laterally deviates in the direction parallel to the lengthwise direction of the first and second support roller 103 and 104. The cause of this lateral deviation of the external heat belt 105 is that the first and second support roller 103 and 104 are not perfectly in parallel to each other, and also, that the aforementioned angle θ is not zero.

Referring to FIG. 7, the axle 209 is positioned so that it extends in the direction which is perpendicular to the area of contact between the fixation roller 101 and external heat belt 105. The axle 209 is a shaft about which the external heating unit 150 is rotationally moved to change the angle θ between the external heat belt 105 and fixation roller 101. In terms of the direction perpendicular to the moving direction of the external heat belt 105, the axle 209 is at the center of the external heating unit 150. Therefore, the external heating unit 150 can keep the frond and rear sides of the nip, balanced in internal pressure, in terms of the lengthwise direction of the fixation roller 101.

In order to control the direction in which the external heat belt 105 laterally shifts, the control section 140 changes the angle θ between the generatrix of the external heat belt 105 and that of the fixation roller 101 by rotationally moving together the first and second support rollers 103 and 014 about the axle 209. That is, in order to keep the lateral deviation of the external heat belt 105 within a preset range, the control section 140 externally forces the angle θ between the generatrix of the external heat belt 105 and that of the fixation roller 101 to change in order to reverse the external heat belt 105 in the direction of its lateral shift.

An axle 203 by which the pressure application frame 201 is rotatably supported is fixed to the lateral plates 202 of the main assembly of the external heating unit 150, by its lengthwise ends. The middle frame 208 and external heat belt 105 are rotationally movable together relative to the pressure application frame 201, about the axle 209. The axle 207*a* is fixed to the middle frame 208. Further, the lateral plate 202, which corresponds in position to the axle 207*a*, is provided with such a hole that provides a certain amount of clearance between the axle 207*a* and lateral plate 202. Thus, the axle 207*a* is allowed to be moved by the movement of the arm portion 118*a* of the worm portion 118 in the directions indicated by arrow marks H and J, within the range which the clearance affords.

The worm wheel 118 is shaped like a fan, and is rotationally movable about the axle 119. It is in engagement with the worm gear 120. As the worm wheel 118 is rotated in the direction indicated by an arrow mark G, by the rotation of a motor 125 in the normal direction, the arm portion 118*a* is moved in the direction indicated by the arrow mark H, causing thereby the axle 207*a* to move in the direction of the arrow mark H. As the worm wheel 118 is rotated in the direction indicated by the arrow mark I by the rotation of the motor 125 in the reverse direction, the arm portion 118*a* is moved in the direction indicated by the arrow mark J, causing thereby the axle 207*a* to move in the direction of the arrow mark J (FIGS. 7 and 8).

As the middle frame 208 is moved in such a direction that its front end moves in the direction indicated by the arrow mark H or J, the first and second support rollers 103 and 104 are made to rotationally moved together about the axle 209. Consequently, the first and second support rollers 103 and 104 become angled relative to the fixation roller 101 by the angle θ. There is a correlation between the angle θ between the fixation roller 101 and external heat belt 105, and the speed at which the external heat belt 105 is made to laterally shift. The amount of the force generated in the direction to laterally move the external heat belt 105 is affected by the distance by which the arm portion 118*a* is moved. Thus, the direction in which the external heat belt 105 is made to laterally shift, and the speed with which the external heat belt 105 is made to laterally shift, are controlled by the direction in which the arm portion 118*a* is moved, and the distance by which the arm portion 118*a* is moved, respectively.

As the axle 207*a* is moved in the direction indicated by the arrow mark H from the position in which the amount of the force which works in the direction to laterally shift the external heat belt 105 is zero, the force which works in the direction to move the external heat belt 105 rearward (indicated by arrow mark M) of the fixation roller 101 increases. On the other hand, as the axle 207*a* is moved in the direction indicated by the arrow mark J from the position in which the amount of the force which works in the direction to laterally shift the external heat belt 105 is zero, the force which works in the direction to move the external heat belt 105 frontward (indicated by arrow mark L) of the fixation roller 101 increases. In other words, the direction (indicated by arrow mark M or L) in which the external heat belt 105 is made to laterally shift can be controlled by changing the direction (indicated by H or J, respectively) in which the axle 207*a* is moved.

In this embodiment, the home position for the axle 207*a*, which is set by the worm wheel 118, is such a position that makes the external heating unit 150 parallel to the fixation roller 101. Whether the axle 207*a* is in its home position or not is detected by a photo-interrupter 135 attached to the worm wheel 118.

As the external heat belt 105 is rotated by the rotation of the fixation roller 101, the external heat belt 105 laterally shifts frontward or rearward of the fixation roller 101. Thus, the control section 140 moves the axle 207*a* in the direction to move the external heat belt 105 in the opposite direction from the direction in which the external heat belt 105 has shifted.

(Belt Position Sensor)

Figure 10:
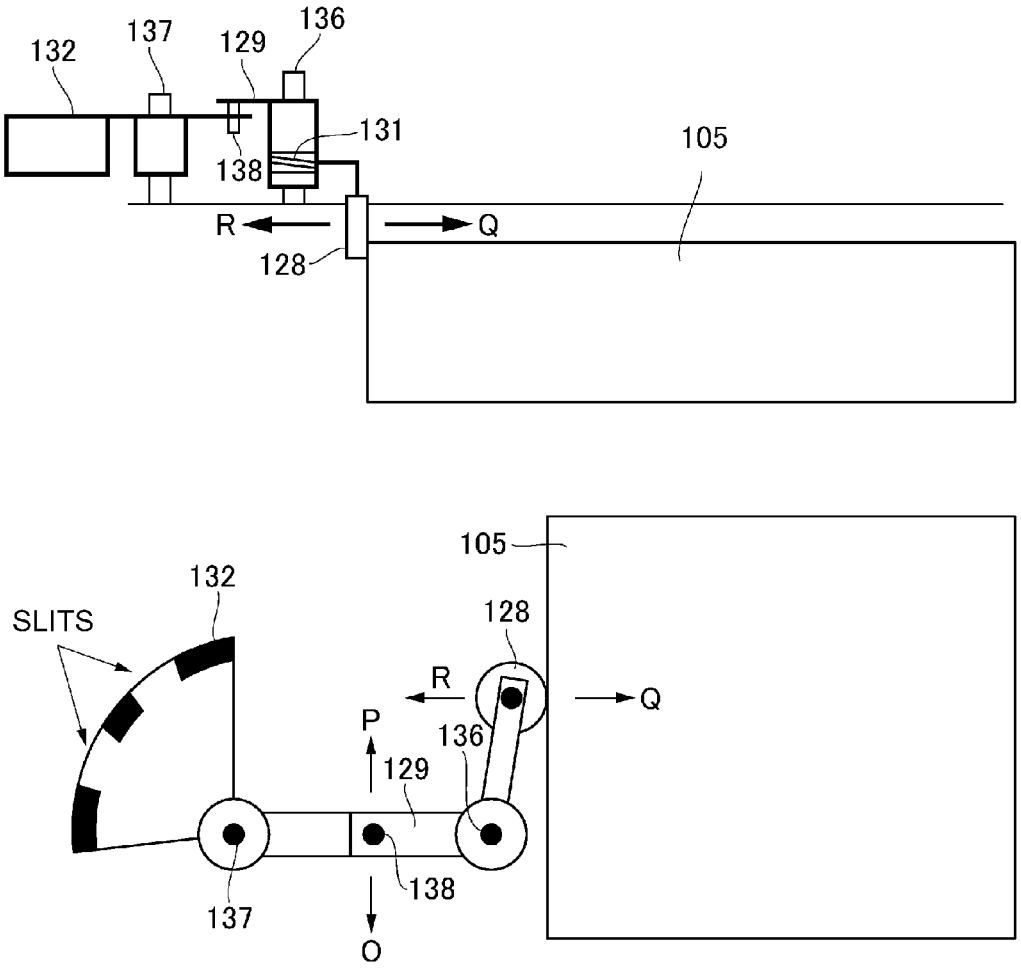
FIG. 10 is a schematic drawing for describing the positioning of the sensor for detecting the amount of lateral deviation of the external heat belt.
Figure 11:
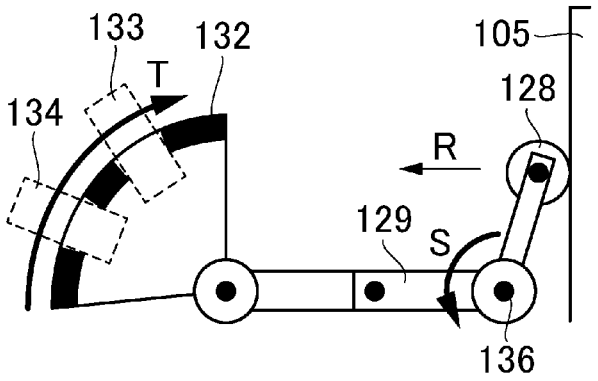
FIG. 11 is a schematic drawing for describing the relationship between the direction of the external heat belt deviation and the direction of the rotational movement of the sensor flag.
Figure 11:
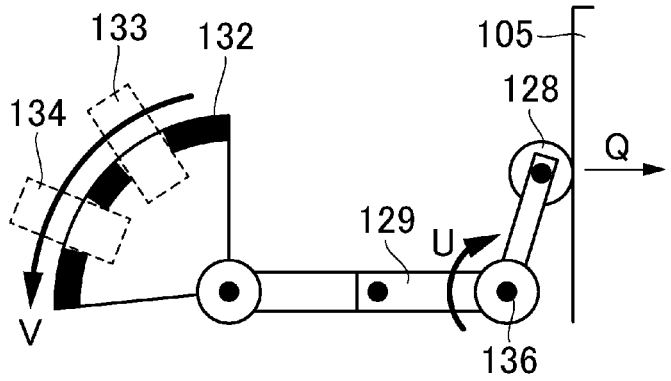

FIG. 10 is a schematic drawing for describing the positioning of the belt position sensor. FIG. 11 is a schematic drawing for describing the positional relationship between the direction of the belt deviation, and the direction of the rotational movement of the sensor flag. Referring to FIG. 10(*b*), an arm 129 and a roller 128 rotate together about an axle 137. A sensor flag 132 rotates about the axle 137.

Referring to FIG. 10(*a*), the arm and sensor flag 132 are connected to each other by an axle 138, and transmit the rotational movement of the combination of the arm 129 and roller 128. The roller 128 is in contact with the edge of the external heat belt 105. A torsion spring 131 provides the arm 129 with a torsional force that keeps the roller 128 pressed in the direction indicated by an arrow mark Q.

Referring to FIG. 10(*b*), as the external heat belt 105 deviates in the direction indicated by the arrow mark Q, the axle 138 is moved in the direction indicated by an arrow mark P. On the other hand, as the external heat belt 105 deviates in the direction indicated by the arrow mark R, the axle 138 is moved in the direction indicated by an arrow mark O.

Referring to FIG. 11(*a*), there are disposed a pair of photo-interrupters 133 and 134 along semicircular edge of the sensor flag 132. The sensor flag 132 is provided with a pair of slits, which provides the sensor flag 132 with four edges, which are detected by the photo-interrupters 133 and 134, which reverse their output as they detect the edges. The four edges of the sensor flag 132 are correlated to the amount of the deviation of the external heat belt 105. For example, the photo-interrupters 132 and 133 are positioned so that the distance by which the external heat belt 105 laterally shifts before it reverses in direction becomes 5 mm. As the external heat belt 105 deviates in the direction indicated by the arrow mark R, the arm 129 is rotationally moved in the direction indicated by the arrow mark S. Thus, the sensor flag 132 is rotationally moved in the direction indicated by the arrow mark T. Consequently, the photo-interrupter 133 is turned off, and the photo-interrupter 134 is turned on.

Referring to FIG. 11(*b*), as the external heat belt 105 deviates in the direction indicated by the arrow mark Q, the arm 129 is rotationally moved in the direction indicated by the arrow mark U. Thus, the sensor flag 132 is rotationally moved in the direction indicated by an arrow mark V. Consequently, the photo-interrupter 133 is turned on, and the photo-interrupter 134 is turned off.

(Comparative External Heating Unit)

Figure 12:
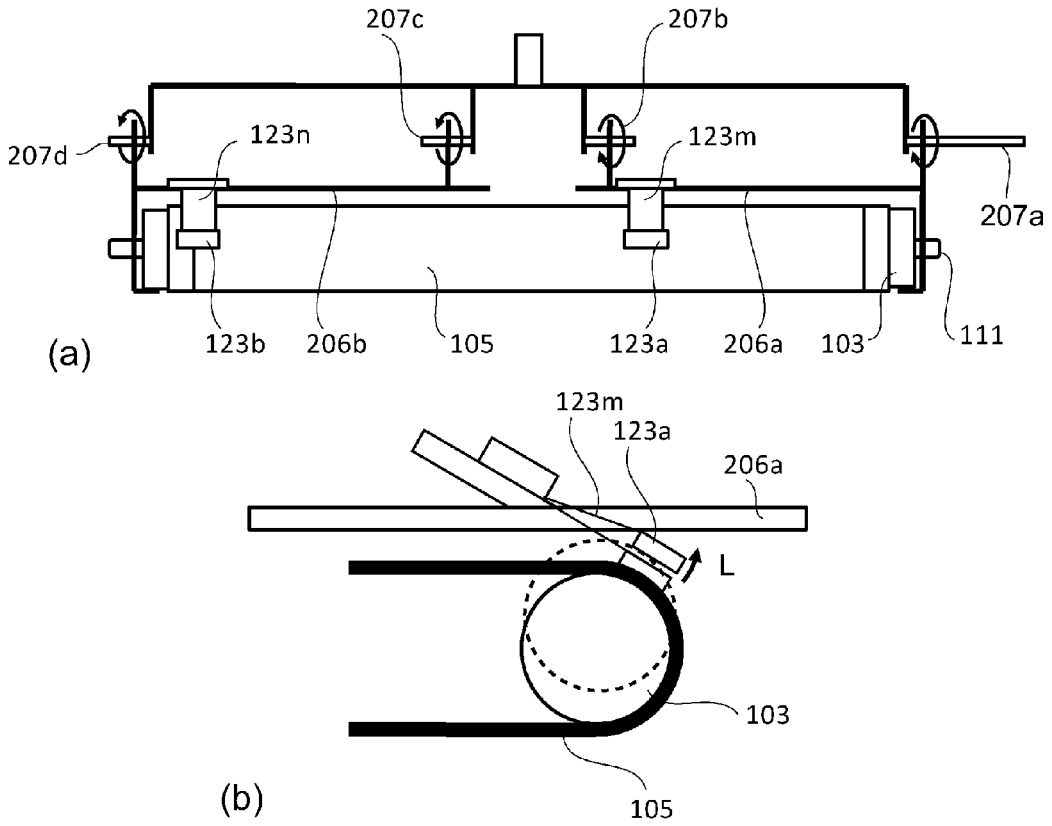
FIG. 12 is a schematic drawing for describing the comparative external heating unit.

FIG. 12 is a schematic drawing for describing the comparative fixing device.

Referring to FIG. 7, the external heating unit 150 places its external heat belt 105 in contact with the fixation roller 101 to directly heat the peripheral surface of the fixation roller 101. The external heating unit 150 rotationally moves about the axle 209 to change the angle θ between the generatrix of the external heat belt 105 and that of the fixation roller 101, controlling thereby the external heat belt 105 in lateral shift. As the external heat belt 105 is controlled in lateral deviation, the holding frames 206*a* and 206*b* are rotationally moved relative to each other, about the combination of the axles 207*a* and 207*b*, and the combination of the axles 207*c*, and 207*d*, respectively. Thus, the first and second support rollers 103 and 104 are angled relative to each other. Consequently, the front and rear sides of the nip between the first support roller 103 and fixation roller 101, and the front and rear sides of the nip between the second support roller 104, become uniform in internal pressure in terms of the lengthwise direction of the fixation roller 101.

In a case where an external heating unit (150) is structured so that there is no limit to the angle by which the first and second heat rollers 103 and 104 are allowed to rotationally moved relative to each other, it is possible that when the external heating unit (150) is assembled, and/or when the external heating unit (150) is lifted independently from the other portions of a fixing device, the angle between the first and second support rollers 103 and 104 will become excessive.

Referring to FIG. 12(*a*), the surface temperature of the external heat belt 105 is detected by the thermistors 123 (123*a* and 123*b*) which are in contact with the portions of the external heat belt 105, which are in contact with the first support roller 103. As the angle between the first and second support rollers 103 and 104 becomes excessive, the distance between the thermistors 123*a* and external heat belt 105, and the distance between the thermistor 123*b* and external heat belt 105, become smaller or larger than the amount of separation which is anticipated to occur as the external heat belt 105 is controlled in its lateral deviation.

Referring to FIG. 12(*b*), in particular, the thermistor 123*a*, which is positioned close to the center of the external heat belt 105, in terms of the widthwise direction of the external heat belt 105, to detect the temperature of the center portion of the external heat belt 105, is seriously affected by the distance. More specifically, if the leaf spring 123*m* by which the thermistor 123*a* is supported is permanently deformed by the excessive increase in the angle between the first and second support rollers 103 and 104, it is possible that the thermistor 123*a* will fail to remain in contact with the outward surface of the external heat belt 105.

In this embodiment, therefore, the comparative external heating unit 150 is provided with a limiter for limiting the angle by which the first and second support rollers 103 and 104 are allowed to be slanted (angled) relative to each other, in order to solve the above described problem which the comparative external heating unit 150 suffers. That is, in the case of the external heating unit 150 in the first embodiment, the limiter regulates the angle by which the first and second support rollers 103 and 104 are allowed to be angled relative to each other. Therefore, the amount by which the leaf spring 123*m*, by which the thermistor 123*a* is kept in contact with the external heat belt 105 to detect the surface temperature of the external heat belt 105, is deformed is reduced.

(Regulating Portion)

Figure 13:
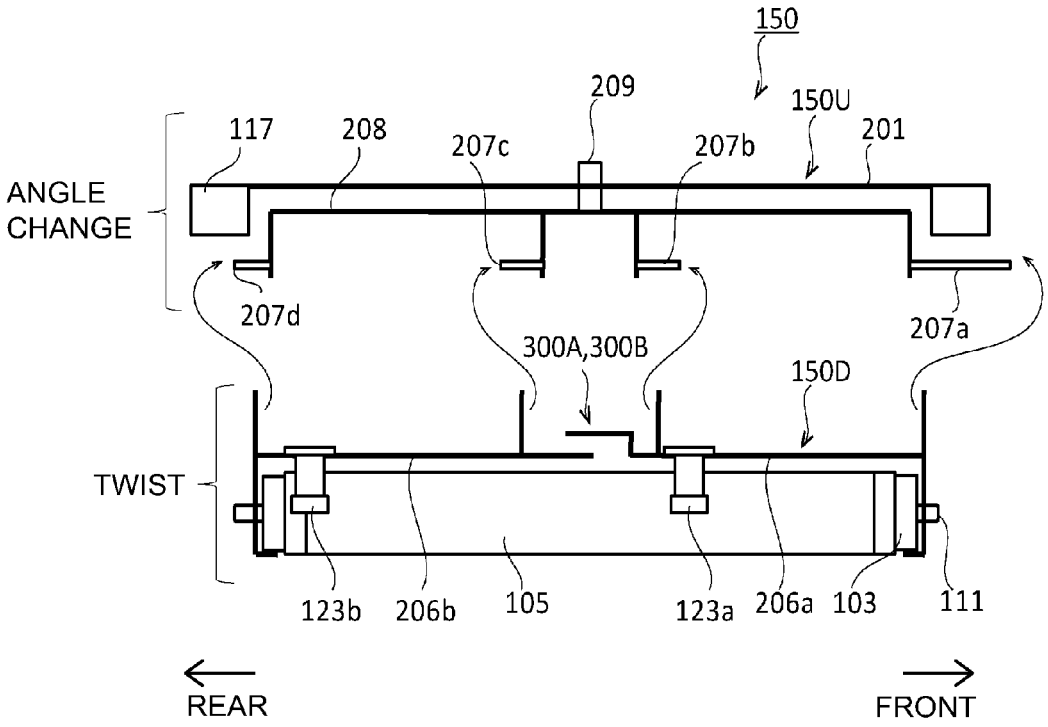
FIG. 13 is a schematic drawing for describing the positioning of the regulating portion in the first embodiment.
Figure 16:
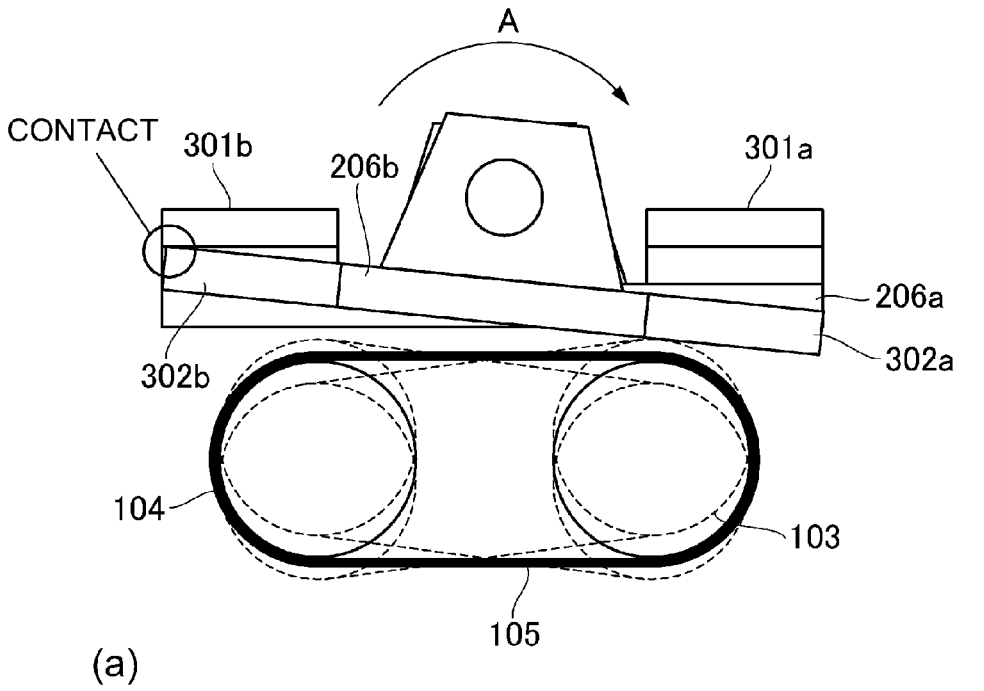
FIG. 16 is a schematic drawing for describing the operation of the regulating portion.
Figure 16:
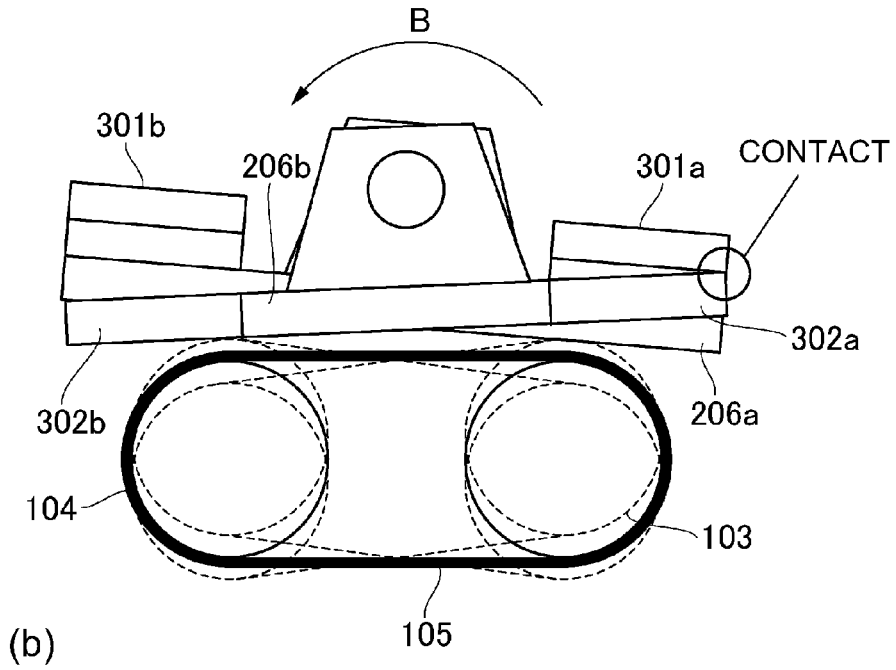

FIG. 13 is a schematic drawing for describing the positioning of the regulating portions (limiting mechanisms) in the first embodiment. FIG. 14 is a schematic drawing for describing the operation of the holding frames. FIG. 15 is a perspective view of the regulating portions. FIG. 16 is a schematic drawing for describing the operation of the regulating portions.

Referring to FIG. 13, the external heating unit 150 is separable into the top and bottom portions 150U and 150D. The top portion 150U rotationally moves the middle frame 208 about the axle 209 to move the middle frame 208 relative to the pressure application frame 201. The bottom portion 150D is rotatably hung by the axles 207*a*, 207*b*, 207*c* and 207*d*, with which the middle frame 208 is provided. The bottom portion 150D rotatably supports one of the lengthwise end of the first support roller 103, and the corresponding lengthwise end of the second support roller 104, by its holding frame 206*a*. Further, it rotatably supports the other lengthwise end of the first support roller 103, and the corresponding lengthwise end of the second support roller 104, by its holding frame 206*b*.

Referring to FIG. 14, the bottom portion 150D rotationally moves the holding frames 206*a* and 206*b* relative to each other in such a manner that the combination of the holding frames 206*a* and 206*b* is twisted at the center of the combination in terms of the lengthwise direction of the combination. As the holding frames 206*a* and 206*b* are rotationally moved relative to each other, the first and second support rollers 103 and 104 become angled relative to each other. Consequently, the nip between the external heat belt 105 and fixation roller 101 autonomously becomes roughly uniform in its internal pressure, in terms of the lengthwise direction of the external heat belt 105.

Referring to FIG. 13, the holding frames 206*a* and 206*b* have regulating portions 300A and 300B which limit the angle by which the holding frames 206*a* and 206*b* are allowed to be rotationally moved relative to each other to limit the angle (amount of displacement) by which the first and second support rollers 103 and 104 are allowed to rotationally move relative to each other.

Referring to FIG. 15, the holding frame 206*a* has two bent portions 301*a* and 301*b*, each of which was formed by bending a part of the holding frame 206*a* at two positions. In terms of the lengthwise direction of the bottom portion 150D, the bent portions 301*a* and 301*b* are at the center of the 150D. In terms of the widthwise direction of the 150D, the bent portions 301*a* and 301*b* are at the widthwise ends of the 150D, one for one. Further, the bent portion 301*a* is on one side of the axle 207*b*, and the bent portion 301*b* is on the other side of the axle 207*b*. The holding frame 206*b* is provided with flat portions 302*a* and 302*b*, which protrude toward the holding frame 206*a* from the inward edge of the main portion of the holding frames 206*b*. The flat portion 302*a* is on one side of the axle 207*c*, and the flat portion 302*b* is on the other wide of the axle 207*c*. Regarding the regulating portion 300A, its bent portion 301*a*, which is a part of the holding frame 206*a*, extends toward the holding frame 206*b*, far enough to reach the area above the flat portion 302*a* of the holding frame 206*b*, overlapping with the flat portion 302*a* of the holding frame 206*b* in terms of the lengthwise direction of the bottom portion 150D. As for the regulating portion, the bent portion 301*b*, which is a part of the holding frame 206*a*, extends to the area above the flat portion 302*b* of the holding frame 206*b*, overlapping with the flat portion 302*b* in terms of the lengthwise direction of the bottom portion 150D.

Referring to FIG. 16(*a*), as the holding frame 206*b* rotationally moves relative to the holding frame 206*a* in the direction indicated by an arrow mark A, the flat portion 302*b* of the holding frame 206*b* comes into contact with the bent portion 301*b* of the holding frame 206*a*, preventing thereby holding frame 206*b* from rotationally moving further.

Referring to FIG. 16(*b*), as the holding frame 206*b* rotationally moves relative to the holding frame 206*a* in the direction indicated by an arrow mark B, the flat portion 302*a* of the holding frame 206*b* comes into contact with the bent portion 301*a* of the holding frame 206*a*, preventing thereby holding frame 206*b* from rotationally moving further.

As described above, as the holding frame 206*b* rotationally moves relative to the holding frame 206*a*, the flat portions 302*a* and 302*b* of the holding frame 206*b* come into contact with the bent portions 301*a* and 301*b* of the holding frame 206*a*, respectively. Therefore, it does not occur that the angle between the first and second support rollers 103 and 104 becomes excessive.

(Rotational Angle of Holding Frames Relative to Each Other)

Figure 17:
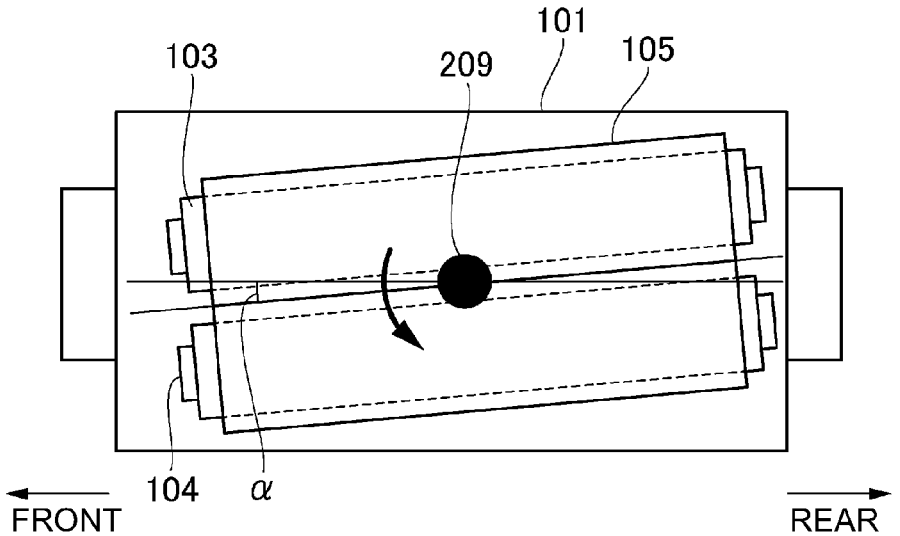
FIG. 17 a schematic drawing for describing the rotational angle of the holding frames relative to each other.
Figure 17:
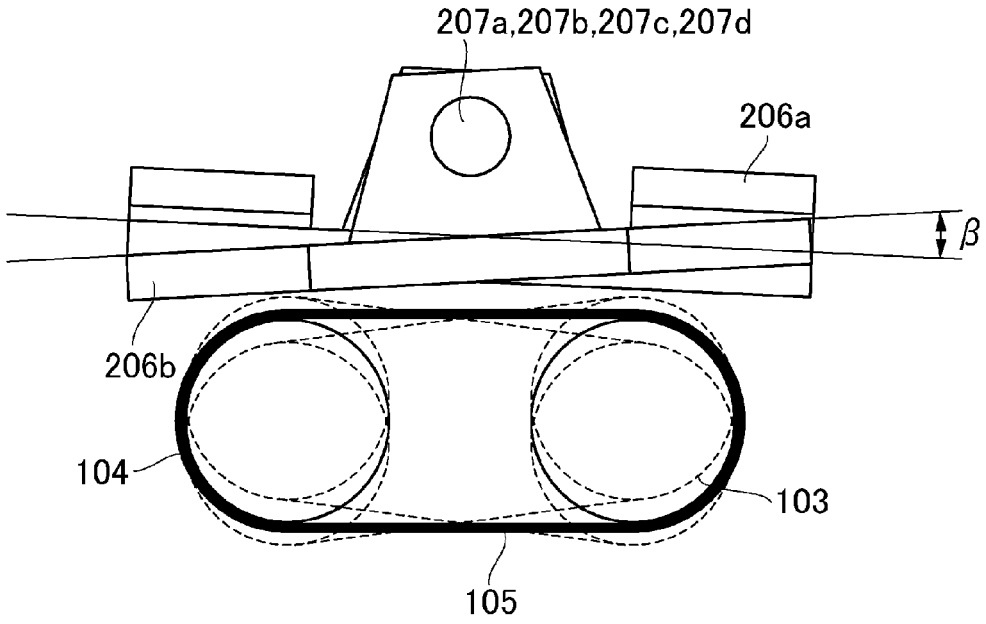
Figure 18:
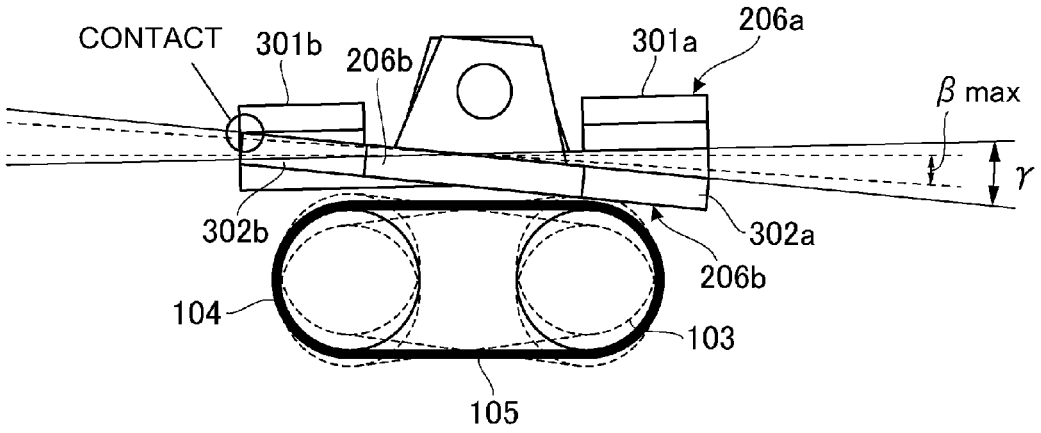
FIG. 18 is a schematic drawing for describing the range to which the angle by which the holding frames are allowed to rotationally move relative to each other is limited.
Figure 19:
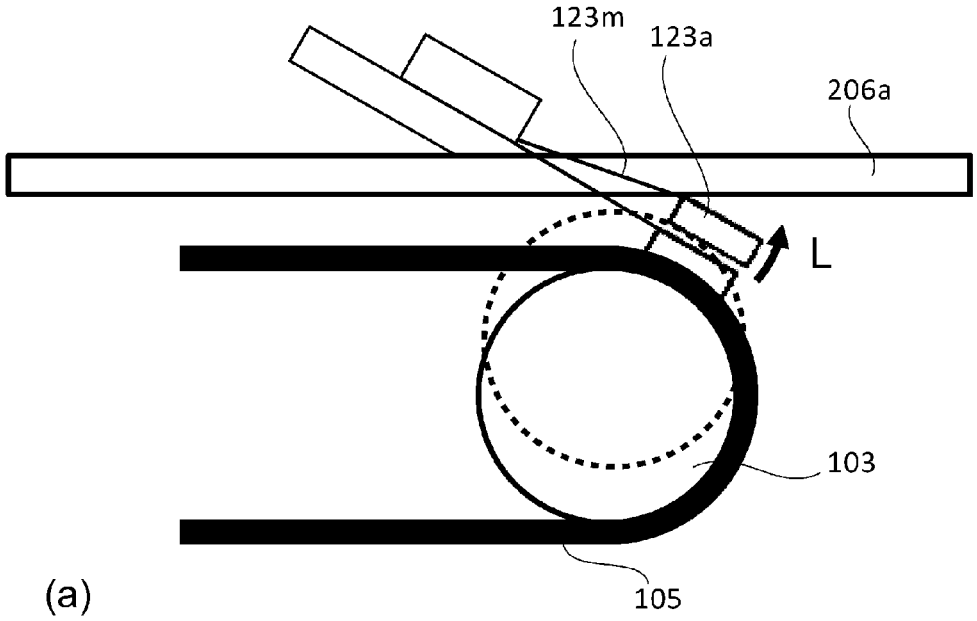
FIG. 19 is a schematic drawing for describing the effects of the first embodiment.
Figure 19:
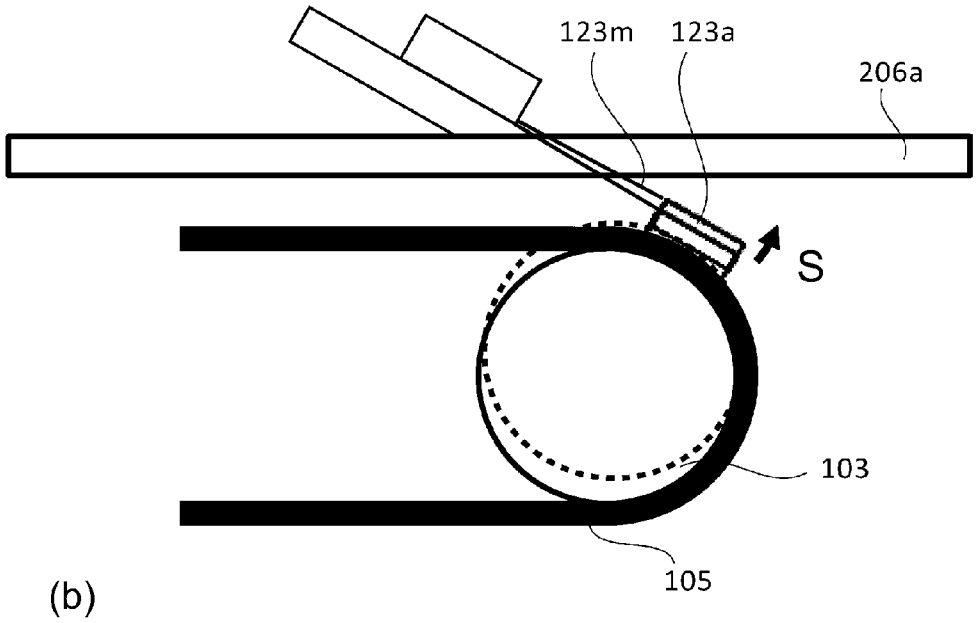

FIG. 17 is a schematic drawing for describing the angle by which the holding frames are allowed to rotationally move relative to each other. FIG. 18 is a schematic drawing for describing the range to which the angle by which the holding frames are allowed to be rotationally moved relative each other is limited. FIG. 19 is a schematic drawing for describing the effects of the first embodiment.

Referring to FIG. 17(*a*), the angle by which the external heating unit 150 is rotationally moved about the axle 209 to change the angle between the generatrix of the fixation roller 101 and that of the external heat belt 105, in order to control the lateral deviation of the external heat belt 105 in the direction parallel to the lengthwise direction of the first and second support rollers 103 and 104. The angle $\alpha$ between the fixation roller 101 and external heat belt 105 is controlled according to the change in the speed of the lateral deviation of the external heat belt 105, change in the distance of the lateral deviation of the external heat belt 105, etc. The angle $\alpha$ is set to be no more than a certain numerical value. In a case where the lateral deviation of the external heat belt 105 cannot be controlled even if the angle $\alpha$ is set to the maximum value, it is determined that something is wrong with the external heating unit 150. Then, an error message is displayed. In the first embodiment, the maximum value $\alpha_x$ for the angle $\alpha$ is set to 2°.

Referring to FIG. 17(*b*), as the angle $\alpha$ between the external heat belt 105 and fixation roller 101 is changed, the first and second support rollers 103 and 104 by which the external heat belt 105 is suspended and kept stretched are rotationally moved relative to each other. That is, they are slanted (angled) relative to each other. As a result, the holding frames 206*a* and 206*b* are rotationally moved (twisted) relative to each other, and therefore, they become slanted relative each other by an angle $\beta$. In this embodiment, the maximum value $\beta_{max}$, for the angle that is, the maximum angle by which the holding frames 206*a* and 206*b* are rotationally movable relative to each other when the angle $\alpha$ between the generatrix of the fixation roller 101 and that of the external heat belt 105 is the maximum value $\alpha_{max}$, is set to 6°. Referring to FIG. 18, the angle $\gamma$ between the holding frames 206*a* and 206*b* when the bent portion 301*b* of the holding frame 206*a* is in contact with the flat portion 302*b* of the holding frame 206*b*, that is, when the holding frame 206*a* and 206*b* are in their positions which do not allowed to rotationally move further relative to each other, is set so that the relation between the angle $\gamma$ and maximum value $\beta_{max}$ satisfies the following mathematical formula:

$$\gamma \geq \beta_{max}.$$

The angle $\gamma$ is affected by the component tolerance. Therefore, the external heating unit 150 is desired to be designed so that the angle $\gamma$ becomes greater than the maximum value $\beta_{max}$ ($\gamma > \beta_{max}$). If the angel $\gamma$ is no more than the maximum value $\beta_{max}$ the first and second support rollers 103 and 104 are insufficiently slanted relative to each other, and therefore, the nip between the external heat belt 105 and fixation roller 101 becomes nonuniform in the internal pressure in terms of the lengthwise direction of the fixation roller 101.

In the first embodiment, the angle $\gamma$ was set to 8° which is greater than the maximum vale $\beta_{max}$, which was 6°. Therefore, it does not occur that when the lateral deviation of the external heat belt 105 is controlled, the nip between the external heat belt 105 and fixation roller 101 is affected in the distribution of its internal pressure in terms of the lengthwise direction of the fixation roller 101. Further, it does not occur that the when the external heating unit 150 is assembled, and/or when the external heating unit 150 is lifted, the first and second support rollers 103 and 104, by which the external heat belt 105 is suspended and kept stretched, are excessively slanted relative to each other.

Referring to FIG. 19(*a*), in the case of the first comparative external heating unit (150), the distance between the external heat belt 105 and thermistor 123*a* is changed by the slanting of the first support roller 103 relative to the second support roller 104 is substantial. Therefore, it is possible that the leaf spring 123*m* will be permanently deformed. Referring to FIG. 19(*b*), in the first embodiment, however, the external heating unit (150) is regulated so that the change which occurs to the distance between the external heat belt 105 and thermistor 123*a* as the first support roller 103 is slanted relative to the second support roller 104 remains relatively small. Therefore, it does not occur that the leaf spring 123*m* is permanently deformed. The first embodiment ensures that when the angle θ between the fixation roller 101 and external heat belt 105 is changed to control the external heat belt 105 in lateral deviation, the holding frames 206*a* and 206*b* are allowed to rotationally move relative to each other by an angle which is satisfactory to keep the nip between the external heat belt 105 and fixation roller 101 uniform in internal pressure in terms of the lengthwise direction of the external heat belt 105. That is, the nip between the external heat belt 105 and fixation roller 101 is not affected in the distribution of its internal pressure, in terms of the lengthwise direction of the external heat belt 105, by the controlling of the lateral deviation of the external heat belt 105. In addition, the first embodiment regulates the angle by the holding frames 206*a* and 206*b* are slanted relative to each other, in order to keep within a tolerable range, the angle by which the first and second supporting rollers 103 and 104 are slanted relative to each other to control the lateral deviation of the external heat belt 105. Therefore, it can reduce the distance by which the leaf spring 123*m* is displaced.

Further, according to the first embodiment, it does not occur that when the external heat belt 105 is replaced, and/or when the external heating unit 150 is individually lifted, the first and second support rollers 103 and 104 become excessively slanted relative to each other.

In the first embodiment, the external heating unit 150 is provided with the axle 209, in order to change the angle between the external heating unit 150 and fixation roller 101 to control the lateral deviation of the external heat belt 105. Further, the external heating unit 150 is structured so that the holding frame 206*a* which holds the first support roller 103 by the lengthwise ends of the roller 103, and the holding frame 206*b* which holds the second support roller 104 by the lengthwise ends of the roller 104, are allowed to be slanted relative to each other.

However, the angle by which the holding frames 206*a* and 206*b* are allowed to be slanted relative to each other is made to be greater than the maximum angle by which the first and second support rollers 103 and 104 are allowed to be slanted relative to each other to control the lateral deviation of the external heat belt 105. Therefore, it is possible to regulate the distance by which the thermistor 123*m*, which is placed in contact with the surface of the external heat belt 105 to detect the surface temperature of the external heat belt 105, is displaced, without causing the slanting of the holding frames 206*a* and 206*b* relative to each other to affect the controlling of the lateral deviation of the external heat belt 105. Therefore, it does not occur that when the external heating unit 150 is assembled, the first and second support rollers 103 and 104 are excessively slanted relative to each other. Therefore, it does not occur that when the external heating unit 150 is assembled, the thermistor 123*a*, which is to remain in contact with the surface of the external heat belt 105 to detect the surface temperature of the external heat belt 105 is displaced by an undesirably large distance.

Embodiment 2

Figure 20:
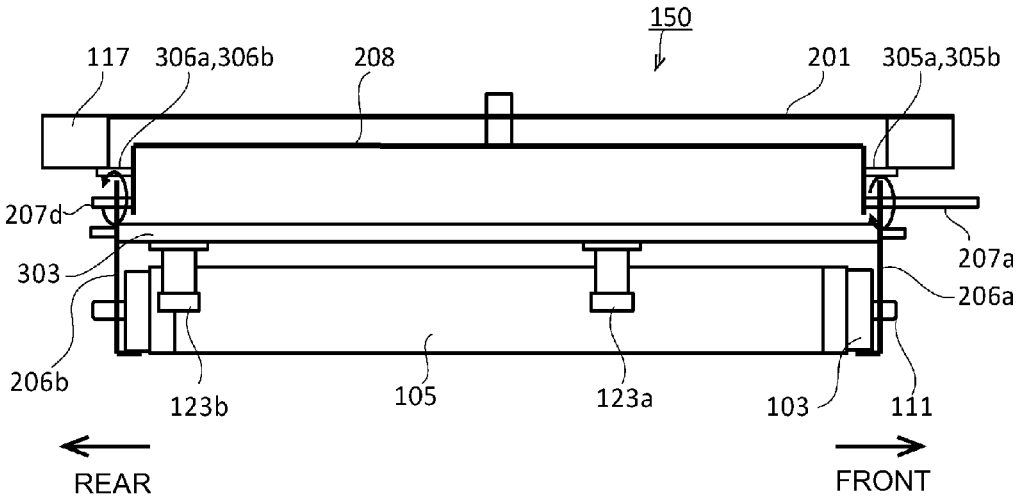
FIG. 20 is a schematic drawing for describing the positioning of the regulating portion in the second embodiment.
Figure 21:
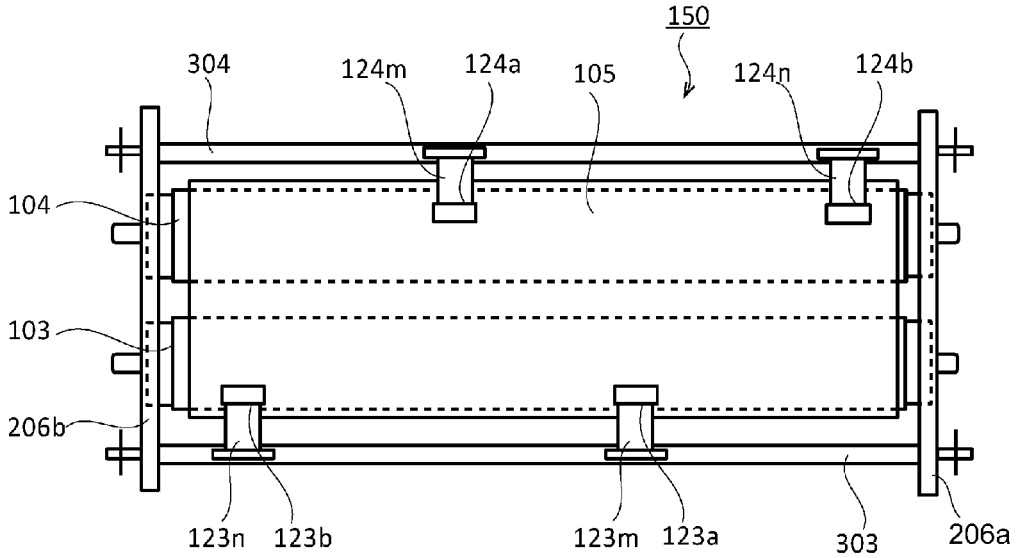
FIG. 21 is a schematic drawing for describing the positioning of the thermistors in the second embodiment.
Figure 22:
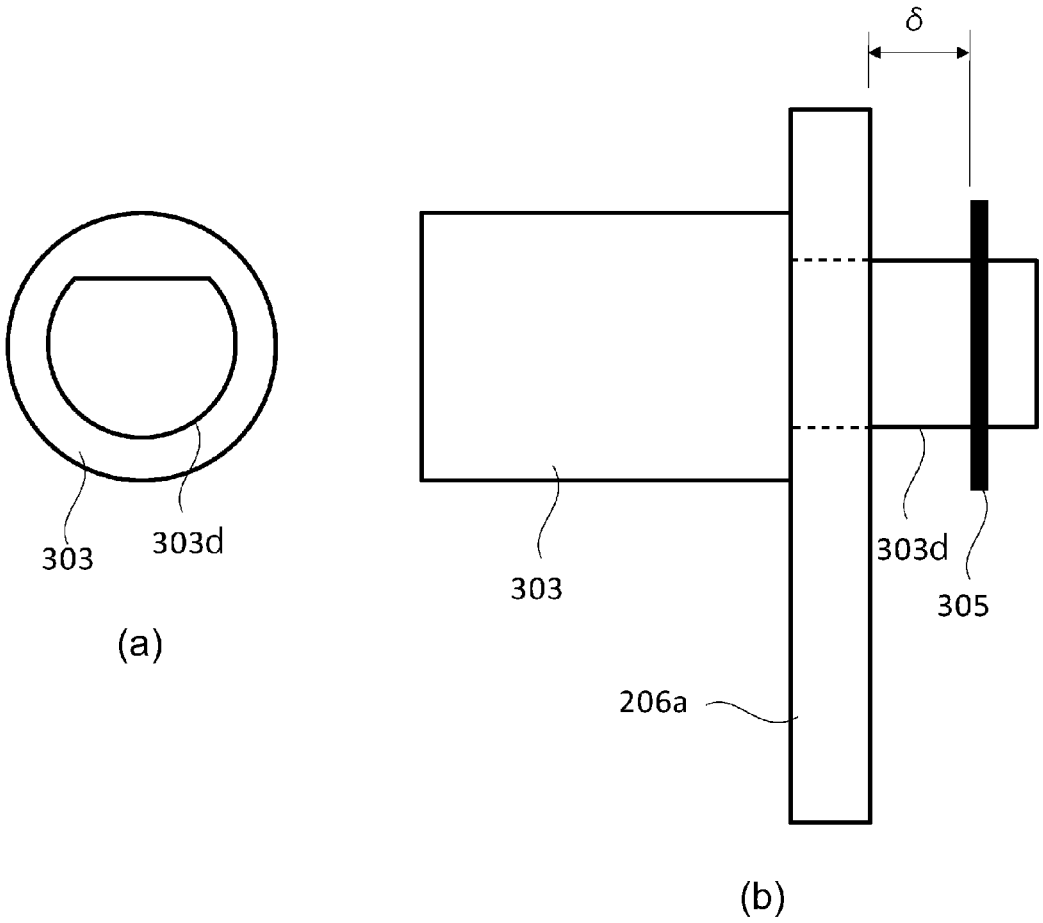
FIG. 22 is a schematic drawing for describing the structure of the mechanism for preventing the sensor supporting shaft from rotating relative to the holding frame.
Figure 23:
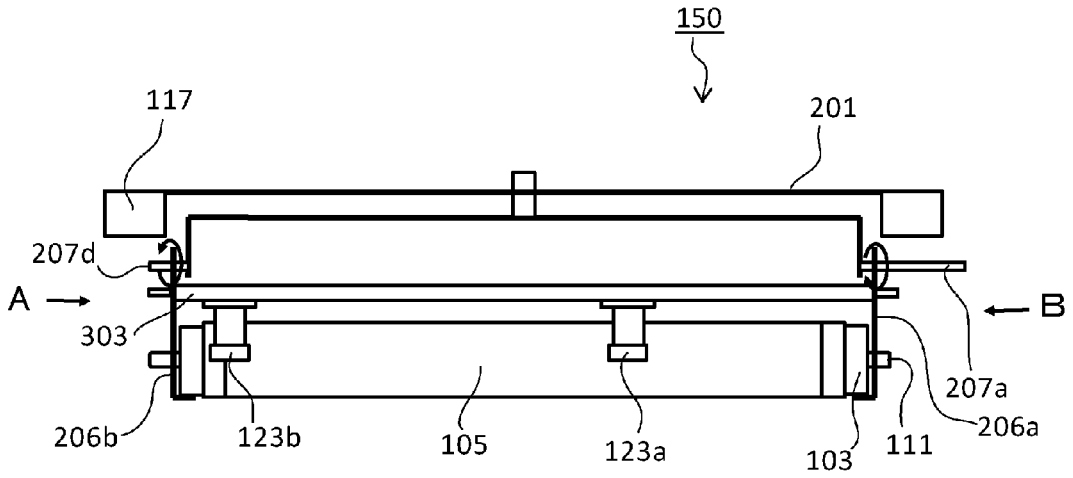
FIG. 23 is a schematic drawing for describing the rotational movement of the holding frames relative to each other.
Figure 23:
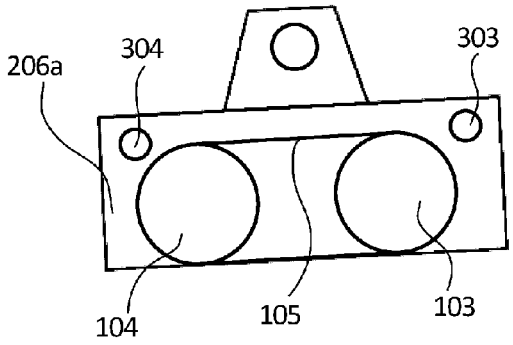
Figure 23:
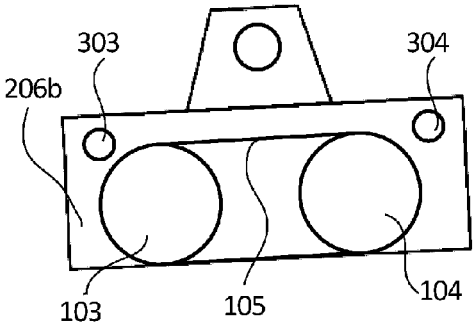
Figure 24:
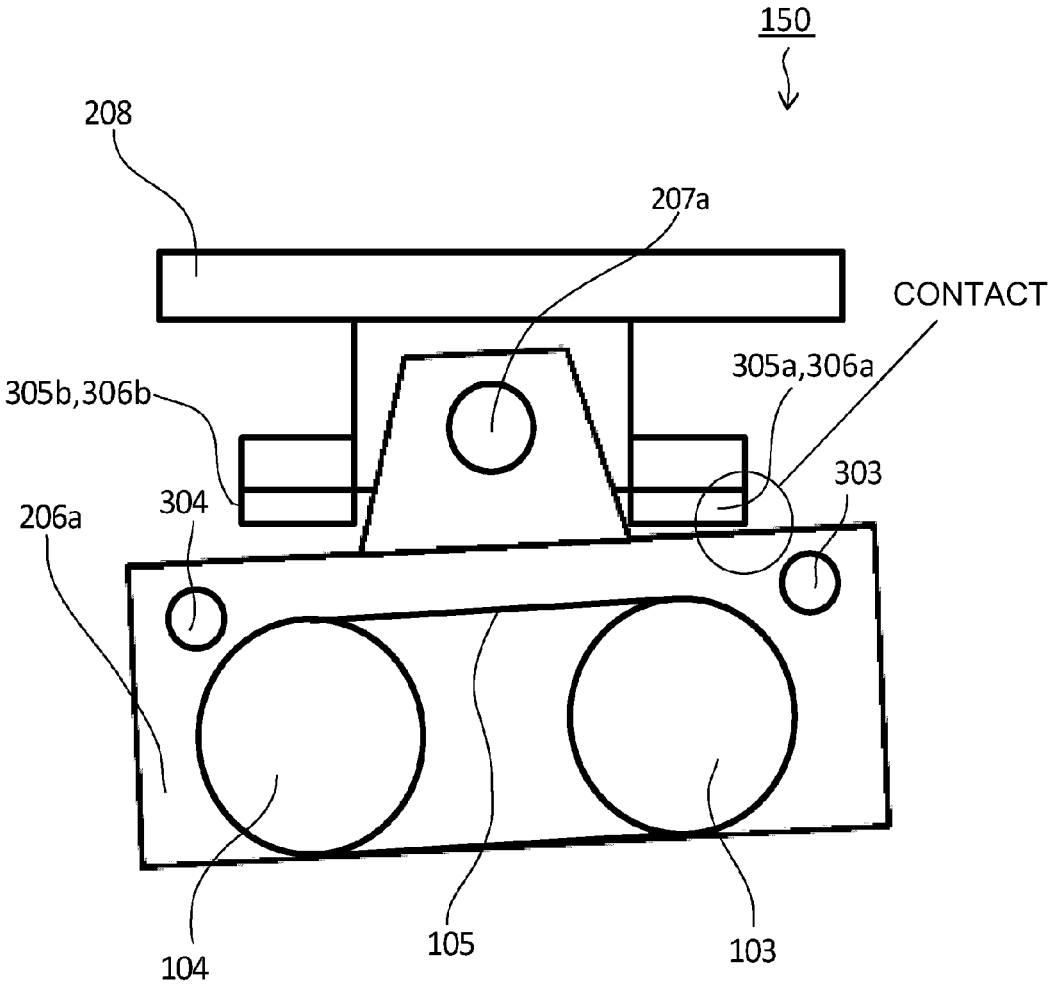
FIG. 24 is a schematic drawing for describing the operation of the regulating portion in the second embodiment.

FIG. 20 is a schematic drawing for describing the positioning of the regulating portion of the external heating unit in the second embodiment of the present invention. FIG. 21 is a schematic drawing for describing the positioning of the thermistors in the second embodiment. FIG. 22 is a schematic drawing for describing the structural arrangement, in the second embodiment, for controlling the rotational movement of the sensor supporting axle relative to the holding frame. FIG. 23 is a schematic drawing for describing the rotationally movement of the holding frames relative to each other, which is caused to slant the frames relative to each other. FIG. 24 is a schematic drawing for describing the operation of the regulating portion in the second embodiment. Referring to FIG. 21, the sensor supporting shaft 303, which is an example of a beam supportable by both of its lengthwise ends, is disposed between the holding frames 206*a* and 206*b* in such a manner that it bridges between the holding frames 206*a* and 206*b*. As the holding frames 206*a* and 206*b* are rotationally moved relative to each other in the direction parallel to the recording medium conveyance direction, the first and second support rollers 103 and 104 are slanted (angled) relative to each other in the direction parallel to the recording medium conveyance direction.

Referring to FIG. 12, in the first embodiment, as the holding frames 206*a* and 206*b* are rotationally moved relative to each other, the distance between the horizontal portion of the holding frame 206*a*, and the peripheral surface of the first support roller 103 substantially changes. Therefore, it is necessary that the leaf spring 123*m* fixed to the horizontal portion of the holding frame 206*a*, by its base portion, substantially deforms to tolerate the large amount of displacement of the thermistor 123*m*.

Referring to FIG. 20, in the second embodiment, as the holding frames 206*a* and 206*b* are rotationally moved relative to each other, the base portion of the leaf spring 123*m* is allowed to move upward or downward to reduce the distance by which the thermistor 123*m* is moved relative to the base portion of the leaf spring 123*m*. Therefore, the range in which the distance between the thermistor 123*a* and the peripheral surface of the first support roller 103, and the distance between the thermistor 123*b* and the peripheral surface of the first support roller 103, are allowed to change as the first and second support rollers 103 and 104 are angled relative to each other, is relatively small.

Referring to FIG. 20, in the second embodiment, the sensor supporting shaft 303 is disposed between the holding frames 206*a* and 206*b*, in parallel to the first support roller 103. Further, the sensor supporting shaft 304 is disposed between the holding frames 206*a* and 206*b*, in parallel to the second support roller 104. Further, the thermistors 123*a* and 123*b* are supported by the sensor supporting shaft 303, and the thermistors 124*a* and 124*b* are supported by the sensor supporting shaft 304.

One of the lengthwise ends of the first support roller 103, and the corresponding lengthwise end of the second support roller 104, are rotatably supported by the holding frame 206*a*, which is rotatably supported by the axle 207*a* attached to the middle frame 208. The opposite lengthwise end of the first support roller 103 from the lengthwise end supported by the holding frame 206*a*, and the corresponding lengthwise end of the second support roller 104, are rotatably supported by the holding frame 206*b*, which is rotatably supported by the axle 207*b* attached to the middle frame 208.

Referring to FIG. 21, the sensor supporting shafts 303 and 304 are put through the holding frames 206*a* and 20*b* in such a manner that they bridge between the holding frames 206*a* and 206*b*. The leaf springs 123*m* and 123*n* are fixed to the sensor supporting shaft 303, by their base portions. The thermistors 123*a* and 123*b* are fixed to the tips of the leaf springs 123*m* and 123*n*, respectively. The leaf springs 124*m* and 124*n* are fixed to the sensor supporting shaft 304, by their base portions. The thermistors 124*a* and 124*b* are fixed to the tips of the leaf springs 124*m* and 124*n*, respectively.

Referring to FIG. 22, the lengthwise end portion of the sensor supporting shaft 303, and the lengthwise end portion of the sensor supporting shaft 304, which are to be put through the holding frame 206*a*, are shaped so that they appear like a letter D in cross-section. That is, the sensor supporting shafts 303 and 304 are prevented from rotating relative to the holding frame 206*a*, while being allowed to rotate relative to the holding frame 206*b*. Further, after the sensor supporting shafts 303 and 304 are put through the holding frames 206*a* and 206*b*, the portions of the sensor supporting shafts 303 and 304, which are on the outward side of the holding frames 206*a* and 206*b*, are fitted with a locking ring 305 which is for preventing the shafts 303 and 304 from disengaging from the holding frames 206*a* and 206*b*.

Referring to FIG. 23(*a*), as the holding frame 206*a* and 206*b* are rotationally moved relative to each other by the controlling of the lateral deviation of the external heat belt 105, the first and second support rollers 103 and 104 are slanted relative to each other, and at the same time, the sensor supporting shafts 303 and 304 are also slanted relative to each other. Therefore, the first and second support rollers 103 and 104 remain roughly parallel to the sensor supporting shafts 303 and 304, respectively. Thus, this embodiment is smaller than the first embodiment, in the amount of the change in the distance between the thermistor 123*a* and the first support roller 103, and the distance between the thermistor 123*b* and first support roller 103, which is caused by the rotational movement of the holding frames 206*a* and 206*b* relative to each other, and also, in the amount of change in the distance between the thermistor 124*a* and second support roller 104, and also, the amount of change in the distance between the thermistor 124*b* and second support roller 104.

Referring to FIGS. 23(*b*) and 23(*c*), therefore, when the first and second support rollers 103 and 104 are slanted relative to each other, the sensor supporting shafts 303 and 304 remain in parallel to the first and second support rollers 103 and 104, respectively. Further, the sensor supporting shafts 303 and 304 are prevented by the locking rings 305 from disengaging from the holding frames 206*a* and 206*b*, because the direction in which the sensor supporting shaft 303 is slanted is the same as the direction in which first support roller 103 is slanted relative to the second support roller 104, and the direction in which the sensor supporting shaft 304 is slanted is the same as the direction in which the second support roller 104 is slanted relative to the first support roller 103.

Therefore, this embodiment is smaller than the first embodiment, in the change, in position, of the areas of contact between the thermistors 123*a* and 123*b* attached to the leaf springs 123*m* and 123*n*, respectively, attached to the sensor supporting shaft 303, and the first support roller 103, and also, in the change, in position, of the areas of contact between the thermistors 124*a* and 124*b* attached to the leaf springs 124*m* and 124*n*, respectively, attached to the sensor supporting shaft 304, and the second support shaft 104. In the second embodiment, therefore, the leaf springs 123*m*, 123*n*, 124*m* and 124*n* are less likely to be permanently deformed by the controlling of the lateral deviation of the external heat belt 105, than in the first embodiment.

However, also in the case of the second embodiment, it is possible that when the external heating unit 150 is assembled, and/or when the external heating unit 150 is independently lifted from the other components of a fixing device, the first and second support rollers 103 and 104 will be slanted relative to each other by an angle large enough to cause the leaf spring 123*m* to be permanently deformed.

Referring to FIG. 20, in this embodiment, therefore, the front side of the middle frame 208 is provided with a pair of flat portions 305*a* and 305*b* to limit the angle by which the holding frame 206*a* is allowed to rotationally move. Further, the rear side of the middle frame 208 is provided with a pair of flat portions 306*a* and 306*b* to limit the angle by which the holding frame 206*b* is allowed to rotationally move.

Referring to FIG. 24, on the front side, as the holding frame 206*a* is rotationally moved relative to the middle frame 208, the holding frame 206*a* comes into contact with the flat portion 305*a* or 305*b* fixed to the middle frame 208. Therefore, the angle by which the holding frame 206*a* is allowed to rotationally move relative to the middle frame 208 is regulated to be in a preset range. On the rear side, as the holding frame 206*b* is rotationally moved relative to the middle frame 208, the holding frame 206*b* comes into contact with the flat portion 306*a* or 306*b* fixed to the middle frame 208. Therefore, the angle by which the holding frame 206*b* is allowed to rotationally move relative to the middle frame 208 is regulated to be in a preset range. The preset ranges for the angles by which the holding frames 206*a* and 206*b* are allowed to rotationally move relative to the middle frame 208 may be the same as those in the first embodiment. That is, they may be set to be slightly wider than the angle by which the first and second support roller 103 and 104 are allowed to be slanted relative to each other to control the external heat belt 105 in lateral deviation, in order not to interfere with the controlling of the lateral deviation of the external heat belt 105. Although FIG. 24 shows only the structure of the holding frame 206*a* and its adjacencies, the holding frame 206*b* and its adjacencies are similar in structure to the holding frame 206*a* and its adjacencies.

The second embodiment is smaller than the first embodiment, in the distance by which the thermistors 123*a*, 123*b*, 124*a* and 124*b* are displaced. Therefore, it is higher than the first embodiment, in the repeatability with which the surface temperature of the external heat belt 105 (first and second support rollers 103 and 104) is accurately detected. On the other hand, in the second embodiment, the rotational movement of the external heating unit 150 is significantly controlled by the presence of the sensor supporting shafts 303 and 304. Therefore, it is significantly smaller than the first embodiment, in the amount of the temperature detection error attributable to the permanent deformation of the leaf springs 123*m*, 123*n*, 124*m* and/or 124*n*.

Embodiment 3

Figure 25:
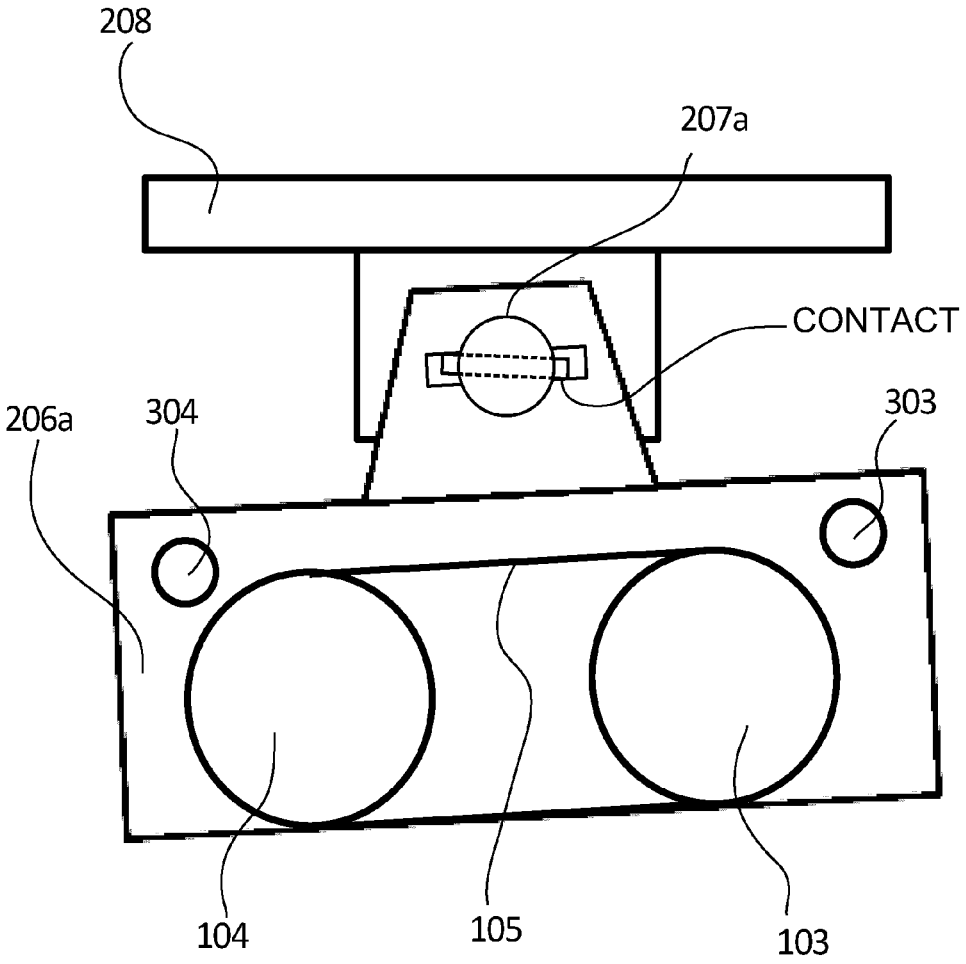
FIG. 25 is a schematic drawing of the regulating portion in the third embodiment.

FIG. 25 is a schematic drawing for describing the regulating portion in the third embodiment of the present invention. Referring to FIG. 25, the number of the areas of the external heating unit 150 to which the mechanism for limiting the angle by which the first and second holding frames are allowed to be slanted relative to each other is attached may be only one. Otherwise, the external heating unit in the third embodiment is similar in structure to the external heating unit 150 in first embodiment.

As will be evident from the foregoing description of the first to third embodiment, the present invention encompasses various image heating apparatuses other than those in the preceding embodiments of the present invention, as long as they are structured so that the angle by which their first and second holding portions are allowed to be slanted relative to each other is limited to be in a preset range, whether they are partially or entirely different in structure from those in the preceding embodiments.

That is, the means for heating a rotational heating member, an endless heating belt (belt supporting members, as well), and the like, does not need to be limited to a halogen heater. For example, a rotational heating member, an endless heating belt, and the like may be provided with a heating layer in which heat can be inductively generated by an alternating magnetic flux. Further, a rotational heating member does not need to be limited to a fixation roller. For example, it may be a pressure roller capable of heating the opposite surface of a sheet of recording medium from the surface having an image.

Further, an image heating apparatus to which the present invention is applicable is not limited to a fixing device such as those in the preceding embodiments. That is, the present invention is also applicable to a surface heating apparatus (device) for altering a temporarily fixed image or a permanent fixed image in surface properties such as glossiness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 025457/2013 filed Feb. 13, 2013, which is hereby incorporated by reference.

What is claimed is:

1. An image heating apparatus comprising:

a rotatable heating member configured to heat a toner image on a recording material;

a belt unit including an endless belt configured and positioned to contact said rotatable heating member to heat said rotatable heating member, and first and second supporting members rotatably supporting an inner surface of said belt and configured to urge said belt to said rotatable heating member;

a detector configured and positioned to detect that said belt is deviated from a predetermined zone with respect to a widthwise direction said belt;

a rotating mechanism configured to rotate said belt unit in a direction for returning said belt into the predetermined zone on a basis of an output of said detector;

a displacing mechanism configured to permit said first supporting member to be displaced, with rotation of said belt unit by said rotating mechanism, in a direction for substantially equalizing forces, from said first supporting member, urging said belt toward said rotatable heating member at opposite end portions of said first supporting member with respect to the widthwise direction and to permit said second supporting member to be displaced, with the rotation of said belt unit by said rotating mechanism, in a direction for substantially equalizing forces, from said second supporting member, urging said belt toward said rotatable heating member at opposite end portions of said second supporting member with respect to the widthwise direction; and a restricting mechanism configured to restrict displacement of said first supporting member beyond a first predetermined position and to restrict displacement of said second supporting member beyond a second predetermined position, wherein the first predetermined position is outside an area in which said first supporting member is displaceable with the rotation of said belt unit by said rotating mechanism, and the second predetermined position is outside an area in which said second supporting member is displaceable with the rotation of said belt unit by said rotating mechanism.

2. An apparatus according to claim 1, wherein said restricting mechanism includes a stopper configured to be abutted by said displacing mechanism so that the displacement of the first supporting member beyond the first predetermined position is restricted and so that the displacement of the second supporting member beyond the second predetermined position is restricted, when said belt unit, said displacing mechanism and said restricting mechanism are integrally dismounted from said apparatus.

3. An apparatus according to claim 2, wherein said displacing mechanism includes:

a first holding member which holds said one end portions of said first and second supporting members and which is swingable around a first axis, with rotation of said belt unit by said rotating mechanism, in directions for substantially equalizing the forces, from said first and second supporting members, urging said belt toward said rotatable heating member at said one end portions; and a second holding member which holds said other end portions of said first and second supporting members and which is swingable around a second axis, with the rotation of said belt unit by said rotating mechanism, in directions for substantially equalizing the forces, from said first and second supporting members, urging said belt toward said rotatable heating member at other one end portions, wherein said stopper is configured to be abutted by said first holding member so that tilting of said first holding member in a circumferential direction about the first axis beyond a predetermined angle is restricted, when said belt unit, said displacing mechanism and said restricting mechanism are integrally dismounted from said the apparatus.

4. An apparatus according to claim 3, wherein said first axis and said second axis are a common axis, wherein said stopper bridges between said first holding member and said second holding member at the position which is outside of said belt and which is different from the common axis.

5. An apparatus according to claim 3, wherein when said first holding member tilts in one circumferential direction about the first axis, said second holding member is tilted in the other circumferential direction about said second axis, and wherein said first holding member tilts in the other circumferential direction about the first axis, said second holding member is tilted in said one circumferential direction about said second axis, with rotation of said belt unit by said rotating mechanism, and said restricting mechanism further includes an additional stopper configured to be abutted by said second holding member so that tilting of said second holding member in said one circumferential direction about the second axis beyond an additional predetermined angle is restricted, when said belt unit, said displacing mechanism and said restricting mechanism are integrally dismounted from said the apparatus.

6. An apparatus according to claim 3, further comprising:

a first temperature detecting member configured and positioned to detect a temperature of said belt;

a first urging member having one end portion fixed to said first holding member and the other end portion supporting said first temperature detecting member, and configured and positioned to urge said first temperature detecting member in a direction for sandwiching said belt between itself and said first supporting member;

a second temperature detecting member configured and positioned to detect a temperature of said belt; and a second urging member having one end portion fixed to said second holding member and the other end portion supporting said second temperature detecting member, and configured and positioned to urge said second temperature detecting member in a direction for sandwiching said belt between itself and said second supporting member.

7. An apparatus according to claim 1, further comprising a temperature detecting member configured and positioned to detect a temperature of said belt, and an urging member having one end portion fixed to said displacing mechanism and the other end portion supporting said temperature detecting member and configured and positioned to urge said temperature detecting member in a direction for sandwiching said belt between itself and said first supporting member.

8. An apparatus according to claim 7, further comprising another temperature detecting member configured and positioned to detect a temperature of said belt, and another urging member having one end portion fixed to said displacing mechanism and the other end portion supporting said temperature detecting member and configured and positioned to urge said another temperature detecting member in a direction for sandwiching said belt between itself and said second supporting member.

9. An apparatus according to claim 1, further comprising a driving mechanism configured to rotate said rotatable heating member, wherein said belt is rotated by said rotatable heating member.

10. An apparatus according to claim 1, wherein said first and second supporting member are provided with respective heaters.

11. An apparatus according to claim 1, wherein said belt unit, said displacing mechanism and said restricting mechanism are integrally dismountable from said apparatus.

12. An image heating apparatus comprising:

a rotatable heating member configured to heat a toner image on a recording material;

a belt unit including an endless belt configured and positioned to contact said rotatable heating member to heat said rotatable heating member, and first and second supporting rollers rotatably supporting an inner surface of said belt and configured to urge said belt to said rotatable heating member;

a detector configured and positioned to detect that said belt is deviated from a predetermined zone with respect to a widthwise direction said belt;

a rotating mechanism configured to rotate said belt unit in a direction for returning said belt into the predetermined zone on the basis of an output of said detector;

a displacing mechanism configured to permit said first and second supporting rollers to be displaced, with rotation of said belt unit by said rotating mechanism, into a positional relation in which axes of said first and second supporting rollers are skewed relative to each other; and a restricting mechanism configured to restrict displacement of said first supporting roller beyond a first predetermined position and to restrict displacement of said second supporting roller beyond a predetermined position, wherein the first predetermined position is outside an area in which said first supporting roller is displaceable with the rotation of said belt unit by said rotating mechanism, and the second predetermined position is outside an area in which said second supporting roller is displaceable with the rotation of said belt unit by said rotating mechanism.

13. An apparatus according to claim 12, wherein said restricting mechanism includes a stopper configured to be abutted by said displacing mechanism so that the displacement of the first supporting roller beyond the first predetermined position is restricted and so that the displacement of the second supporting roller beyond the second predetermined position is restricted, when said belt unit, said displacing mechanism and said restricting mechanism are integrally dismounted from said apparatus.

14. An apparatus according to claim 13, wherein said displacing mechanism includes:

a first holding member which holds said one end portions of said first and second supporting rollers and which is swingable around a first axis, with rotation of said belt unit by said rotating mechanism, in directions for substantially equalizing the forces, from said first and second supporting rollers, urging said belt toward said rotatable heating member at said one end portions; and a second holding member which holds said other end portions of said first and second supporting rollers and which is swingable around a second axis, with the rotation of said belt unit by said rotating mechanism, in directions for substantially equalizing the forces, from said first and second supporting rollers, urging said belt toward said rotatable heating member at other one end portions, wherein said stopper is configured to be abutted by said first holding member so that tilting of said first holding member in a circumferential direction about the first axis beyond a predetermined angle is restricted, when said belt unit, said displacing mechanism and said restricting mechanism are integrally dismounted from said the apparatus.

15. An apparatus according to claim 14, wherein said first axis and said second axis are a common axis, and wherein said stopper bridges between said first holding member and said second holding member at the position which is outside of said belt and which is different from the common axis.

16. An apparatus according to claim 14, wherein when said first holding member tilts in one circumferential direction about the first axis, said second holding member is tilted in the other circumferential direction about said second axis, and wherein said first holding member tilts in the other circumferential direction about the first axis, said second holding member is tilted in said one circumferential direction about said second axis, with rotation of said belt unit by said rotating mechanism, and said restricting mechanism further includes an additional stopper configured to be abutted by said second holding member so that tilting of said second holding member in said one circumferential direction about the second axis beyond an additional predetermined angle is restricted, when said belt unit, said displacing mechanism and said restricting mechanism are integrally dismounted from said the apparatus.

17. An apparatus according to claim 14, further comprising:

a first temperature detecting member configured and positioned to detect a temperature of said belt;

a first urging member having one end portion fixed to said first holding member and the other end portion supporting said first temperature detecting member, and configured and positioned to urge said first temperature detecting member in a direction for sandwiching said belt between itself and said first supporting roller;

a second temperature detecting member configured and positioned to detect a temperature of said belt; and a second urging member having one end portion fixed to said second holding member and the other end portion supporting said second temperature detecting member, and configured and positioned to urge said second temperature detecting member in a direction for sandwiching said belt between itself and said second supporting roller.

18. An apparatus according to claim 12, further comprising a temperature detecting member configured and positioned to detect a temperature of said belt, and an urging member having one end portion fixed to said displacing mechanism and the other end portion supporting said temperature detecting member and configured and positioned to urge said temperature detecting member in a direction for sandwiching said belt between itself and said first supporting roller.

19. An apparatus according to claim 18, further comprising another temperature detecting member configured and positioned to detect a temperature of said belt, and another urging member having one end portion fixed to said displacing mechanism and the other end portion supporting said temperature detecting member and configured and positioned to urge said another temperature detecting member in a direction for sandwiching said belt between itself and said second supporting roller.

20. An apparatus according to claim 12, further comprising a driving mechanism configured to rotate said rotatable heating member, wherein said belt is rotated by said rotatable heating member.

21. An apparatus according to claim 12, wherein said first and second supporting rollers are provided with respective heaters.

22. An apparatus according to claim 12, wherein said belt unit, said displacing mechanism and said restricting mechanism are integrally dismountable from said apparatus.

* * * * *